US012114748B1

(12) United States Patent
Majhess et al.

(10) Patent No.: US 12,114,748 B1
(45) Date of Patent: Oct. 15, 2024

(54) BATTERY LATCH ASSEMBLY AND RETRACTABLE BATTERY COVER FOR LUGGAGE AND OTHER TRAVEL BAGS

(71) Applicant: OBSIDIAN LUGGAGE TECHNOLOGIES INTERNATIONAL, INC., San Juan, PR (US)

(72) Inventors: Joseph M. Majhess, Boca Raton, FL (US); Mark A. Jacobs, San Juan, PR (US); Craig Benson, Melbourne Beach, FL (US)

(73) Assignee: OBSIDIAN LUGGAGE TECHNOLOGIES INTERNATIONAL, INC., San Juan, PR (US)

( * ) Notice: Subject to any disclaimer, the term of this patent is extended or adjusted under 35 U.S.C. 154(b) by 0 days.

(21) Appl. No.: 17/589,741

(22) Filed: Jan. 31, 2022

Related U.S. Application Data

(60) Provisional application No. 63/144,452, filed on Feb. 1, 2021.

(51) Int. Cl.
*A45C 13/10* (2006.01)
*A45C 5/03* (2006.01)
(Continued)

(52) U.S. Cl.
CPC ..... *A45C 13/1084* (2013.01); *A45C 5/03* (2013.01); *A45C 5/14* (2013.01); *A45C 13/262* (2013.01);
(Continued)

(58) Field of Classification Search
CPC ..... A45C 13/1084; A45C 5/03; A45C 5/14; A45C 13/262; A45C 13/28; A45C 15/00; A45C 2013/267
See application file for complete search history.

(56) References Cited

U.S. PATENT DOCUMENTS 10,219,599 B2 * 3/2019 Korey ..... A45C 5/06
10,376,031 B1 * 8/2019 Majhess ..... A45C 13/02
(Continued)

FOREIGN PATENT DOCUMENTS

CN 205831311 U * 12/2016
WO WO-2018185016 A1 * 10/2018 ..... A45C 13/18

*Primary Examiner* — Tri M Mai
(74) *Attorney, Agent, or Firm* — DANIEL S. POLLEY, P.A.

(57) ABSTRACT

Several novel components for Travel Bags and Travel Bag accessories are disclosed including a retractable trolley which has multiple adjustable handle heights along substantially all of the range of distance of its telescopic trolley tubes which permits the user to select and to fix the trolley pull handles at a height of their selection, a retractable hingeless plastic cover which in a closed position covers and protects an opening for a removable battery and which in open position permits the removal of the removable battery and/or access by the user to the battery face for charging and recharging purposes; a divider which can be fastened in place with adjustable side squeeze buckles or releasing and fastening clips either of which are adjustable to hold the contents in place; a battery latching and ejection system for a removable battery, a retractable power chord for rechargeable batteries or rechargeable electronic devices, and a connector cap which connects a vacuum pump with a vacuum compression bag valve and which is removable after the use of the vacuum pump.

13 Claims, 13 Drawing Sheets

Fig. 7B

(51) Int. Cl.

| | |
|---|---|
| ***A45C 5/14*** | (2006.01) |
| ***A45C 13/26*** | (2006.01) |
| ***A45C 13/28*** | (2006.01) |
| ***A45C 15/00*** | (2006.01) |

(52) U.S. Cl.
CPC ..... *A45C 13/28* (2013.01); *A45C 15/00* (2013.01); *A45C 2013/267* (2013.01)

(56) References Cited

U.S. PATENT DOCUMENTS

| | | | | |
|---|---|---|---|---|
| 11,110,949 | B2 * | 9/2021 | Yao | G05D 1/0246 |
| 2015/0089903 | A1 * | 4/2015 | Carey | A45C 13/02 53/434 |
| 2017/0290401 | A1 * | 10/2017 | Bhatnagar | A45C 13/28 |
| 2019/0254401 | A1 * | 8/2019 | Rubio | A45C 5/06 |
| 2021/0093064 | A1 * | 4/2021 | Roosen | A45C 5/03 |

* cited by examiner

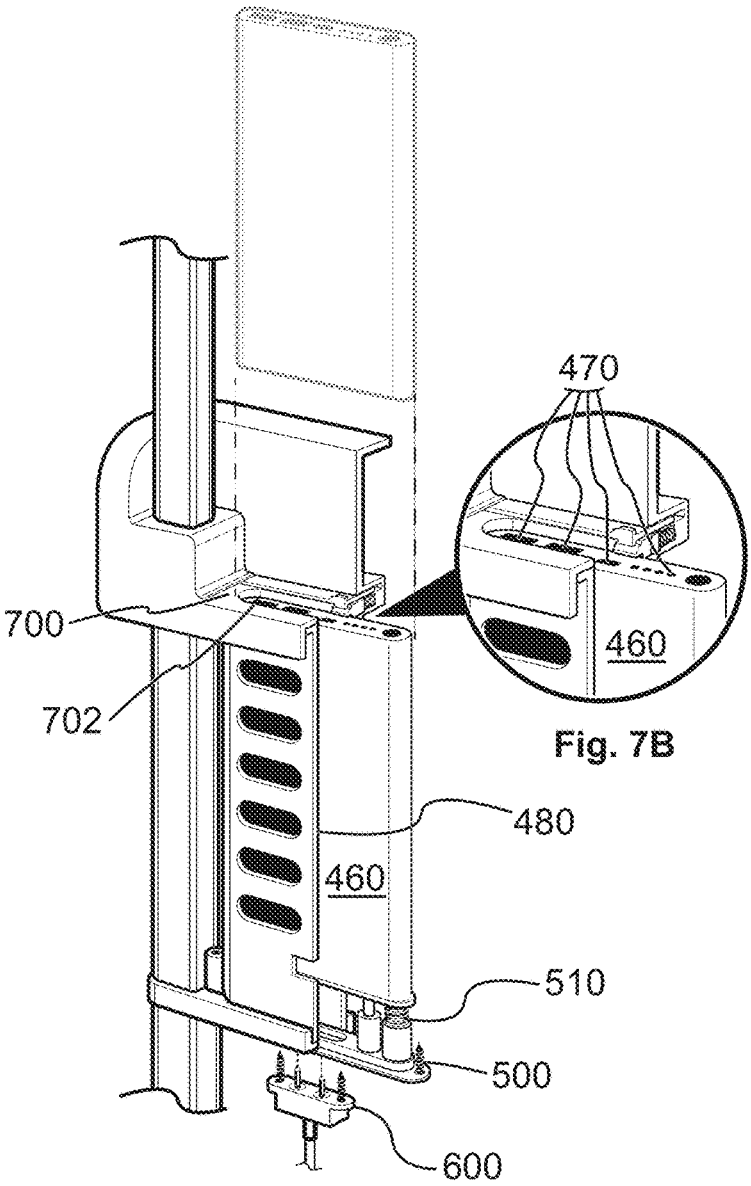
Fig. 7A
Fig. 7B
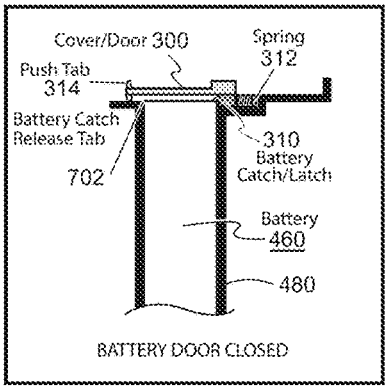
Fig. 7C
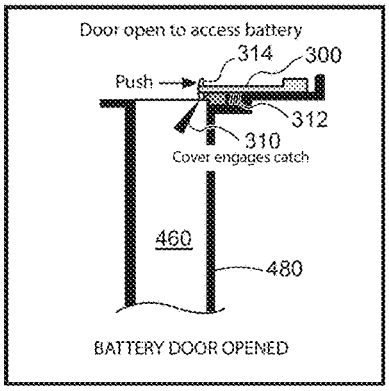
Fig. 7D
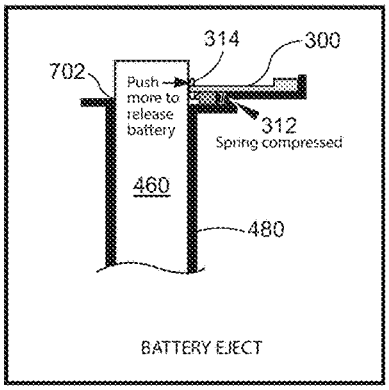
Fig. 7E

BATTERY LATCH ASSEMBLY AND RETRACTABLE BATTERY COVER FOR LUGGAGE AND OTHER TRAVEL BAGS

This application claims the benefit of and priority to U.S. Application Ser. No. 63/144,452, filed Feb. 1, 2021, which application is incorporated by reference in its entirety for all purposes.

FIELD OF THE DISCLOSURE

The disclosure relates to travel accessories, including, but not limited to, rolling or wheeled travel bag or accessories.

BACKGROUND

Travel Bags with removable batteries have the issue of covering and protecting the battery from rain/moisture/dust in the environment on the exterior of the Travel Bag. Recent developments to Travel Bags in general are the inclusion of a removable battery to the Travel Bag. The advantage of a removable battery is the convenience of having a rechargeable battery with the capability of charging or recharging cell phones, tablets, laptops, or similar electronic devices. There is generally a dual need 1) to be able to remove the battery for external use, and 2) to be able to use the battery in place inside the Travel Bag for charging or recharging purposes. As a result of this general dual need, there is generally a requirement that the battery opening be covered to prevent moisture or dust from entering the space where the battery is located. There are several types of covers to serve the functions of covering or sealing the battery opening. Some are hinged covers which open like a book cover. Others are rubberized covers which are squeezed into place and held in place by the cap material itself. Travel Bags with removable batteries also require a latching system to hold the battery in place in relation to its internal electrical connections as well as an ejection system to enable the user to remove the battery from the interior of the Travel Bag.

Additionally, for the past several decades telescoping trolley handles have been incorporated into a variety of wheeled carriers that humans use. Typically, these telescoping trolley handles are adjustable to one, two, or at most three fixed positions above their lowest fixed position. Telescoping retractable trolley handles for Travel Bags have been engineered to fix the handle height at one, two, or three pre-set levels where typically a fixing pin is used to protrude through a preset hole to keep the trolley extended to that fixed height. While Travel Bag users come in all shapes and sizes and with a variety of personal preferences, the design of the retracting trolley does not take individual sizes or preferences into account. Short, medium, or tall persons have different physical characteristics which affect the utility of moving or hauling the Travel Bag by its pull handle. Today's Adjustable Height Trolley Handles have limited adjustability of the final extended height of the trolley handle and are typically engineered to provide for three or fewer pre-set stops. The user has no options to set the trolley handle height between the preset stops.

Travel Bags also often contain dividers which are used to separate the top and the bottom halves of the shell or outer sides of the Travel Bag.

Lastly, rechargeable electronic devices and rechargeable batteries often require a direct plug in connection with wall electrical sockets to accomplish recharging. The recharging cord for these devices or batteries consists of a connector end and a length of electrical cord which contains the wires through which electricity flows to accomplish the recharging and a "male" plug that can be seated to a wall electrical plug receptacle. Travel Bags which contain rechargeable batteries have a required electric plug in and power cord with a recharging end (typically a USB connection but the interface can be other charger endings.) Rechargeable batteries and electronic devices require charging often by a charging cord that is engineered to provide the correct amount of DC power to the battery or the electronic device. The lengths of the power cord can vary. The connection end of the charging cord may be a Universal Serial Bus ("USB") which is the interface between the charging source and the device being charged. Other connecting ends can be utilized depending upon the interface design of the rechargeable battery or electronic device. The plug in end may be a two or three plug in prong plug designed to connect with electrical outlets providing electric power. The prongs of the plug may be hinged to provide a flush end of the plug when its prongs are not in use. The configuration of plugs can differ for different countries or different power settings from the power source. Common features of this system are a "male" plug or connection into the power source (typically a wall electrical plug receptacle), a length of cord containing the wires which provide power or other communications functions, and an interface at the end of the power cord for connection to the battery or device being recharged.

The current disclosure is directed to addressing the above known problems with current devices for travel accessories/wheeled travel accessories/bags and/or improving such devices.

SUMMARY OF THE DISCLOSURE

A first novel device provides for an adjustable height trolley handle which can be fixed at multiple locations, and preferably more than three positions (though not limiting) along the entire range of the telescoping height of the telescoping tubes with minimal spaces between each fixation point. One non-limiting advantage provided by the novel adjustable height trolley handle is that the user can adjust the handle height of the adjustable height of the trolley handle to any height between the first stop position and the final height extension heights permitted by the trolley structure and, thus, the trolley handle height can be customized/selected more correctly to the physical characteristics of the user. A novel control button permits the smooth extension of the trolley handle to the precise or virtually precise height desired by the user. This can preferably optimize the utility of an adjustable height trolley handle with the user's personal physical characteristics and personal preferences. The novel Numerous Positions/Adjustable Height Trolley handles can be broadly applicable to a broad class of Travel Bags and Wheeled Cases (each of which are further defined below, without limitation) where a fully adjustable trolley handle height would be a desirable component.

In connection with the use of adjustable height trolley handles with Travel Bags (as further defined below) the novel device can permit the user of the Travel Bag to set the adjustable height of the extendable telescoping adjustable trolley to the height that they choose between the first stopping position and the maximum handle height permitted by the Travel Bag trolley structure, while also allowing another user of the same Travel Bag to easily adjust the trolley height to their specific physical characteristics.

Accordingly, the novel retractable trolley preferably has multiple adjustable handle heights and preferably greater than three adjustable heights. The novel trolley provides for a telescopic retractable trolley pull handle for Travel Bags above the initial preset stopping point in order to provide the user with the ability to adjust the height of their Travel Bag trolley handle to a height of their selection between fully closed and fully extended. In one novel non-limiting embodiment, the user can release the control button at the height they select, and the internal fixing mechanism holds the Travel Bag trolley handle at that height until the user changes the height or causes the trolley and trolley handle to be fully telescopically retracted into the travel bag.

A second novel device provides for the use of a retractable hingeless plastic cover operable within the Bridge of the Trolley which the user can slide into an open or closed position without the cover becoming detached from the Travel Bag. Though not considered limiting, for purposes of understanding this disclosure, the definition of the term "Bridge" (hereafter "Bridge") can be considered to encompass a solid collar piece of the trolley assembly which holds the first stage trolley tubes in place at the top of the Travel Bag and with the proper spacing of the trolley tubes, and provides for an opening through which the battery may be inserted or withdrawn and the battery release button is seated, and/or which serves as the holder and guide system of the retractable hingeless battery cover.

Built in guides for the plastic cover permit the user to open the cover by pushing the cover into the interior of the Bridge of the Travel Bag. When the cover is an "opened" position, the removal of the battery from the interior of the Travel Bag is permitted or the user's access to the battery is provided for charging or recharging while the battery is located within the Travel Bag. When the user decides to close the cover, the user slides the cover from within the Bridge of the trolley assembly along the built in guides to bring the cover to a fully closed position where it can be preferably held in a closed position by built in stops or cover locking strips or a functional plastic click-in-place locking assembly, in certain non-limiting embodiments. Due to the fact that the retractable cover can be positioned on top of the Bridge the cover remains substantially above the Bridge battery opening and is not substantially flush with the Bridge battery opening. In one non-limiting embodiment, the battery opening cover can be plastic and can slide into the interior space of the Bridge of the Travel Bag when in an "open" position to grant the user access to the battery or to insert or eject the battery from the interior of the Travel Bag through the battery opening in the Bridge and when in a "closed" position will cover and seal the battery opening to prevent the entry of moisture, dust, or dirt to the battery or the interior of the Travel Bag. The preferred sliding plastic cap is easy to operate and efficiently performs its intended functionality. Due to the fact that the retractable cover is positioned on top of the Bridge the cover remains substantially above the Bridge battery opening and is not substantially flush with the Bridge battery opening.

Travel Bags often contain dividers which are used to separate the top and the bottom halves of the shell or outer sides of the Travel Bag. Disclosed herein is a novel fastening system using plastic squeeze buckles or similar locking assemblies onto a Travel Bag divider which permits the fastening of the divider by the squeeze buckles or fasteners to the interior side of the Travel Bag. The plastic squeeze buckles can be adjustable by adjusting straps tightened by the user to secure the contents of the Travel Bag that have been packed beneath the divider and to prevent movement of packed items. The end result is that packed contents beneath the divider can be kept in a snug position within the Travel Bag. Thus, a novel Travel Bag divider with squeeze buckle fasteners with adjustable straps is provided. As an alternative to plastic squeeze buckles and also within the scope of the disclosure, plastic fastening clips can be provided onto the Travel Bag divider for the divider to the interior side of the Travel Bag (i.e. by either the squeeze buckles or fastening clips or other locking assembly). The fastening clips can be secured by sewing or similar means on the side of the Travel Bag and preferably no more than half-way across the divider (though not considered limiting).

The connection point of the fastening clips can be near the outer edge of the travel bag and preferably not in the middle of the divider (though again not considered limiting). The fastening clips can be opposite the hinged portion of the divider. The hinged portion of the divider can be attached to the inner portion of the Travel Bag in a manner that permits the divider's movement to an open or closed position by the user. The hinged side of the divider may be attached to the inner portion of the Travel Bag so as to be preferably non-removable by the user in one embodiment, or may be connected by squeeze buckles or fastening clips to make the Divider removable by the user in another embodiment. The plastic squeeze buckles or fastening clips may be adjustable from the side fastening clips or the fastening clips attached to the divider itself. The fastening clips may have adjustable straps by which the user can pull the clips closer together. The user's adjustment of the adjustable straps permits the user to secure or to snug up the contents of the Travel Bag that have been packed beneath the divider and to prevent movement of packed items. The end result is that packed contents beneath the divider are kept in a fixed and snug position within the Travel Bag.

Travel Bags with removable batteries require a latching system to hold the battery in place in relation to its internal electrical connections as well as an ejection system to enable the user to remove the battery from the interior of the Travel Bag. The instant disclosure provides for a novel battery latching and battery release and ejection from the interior of the Travel Bag which permits both case of use and a snug electrical connection between the battery and the vacuum pump system (or other electrical device) that the battery powers. Thus, a novel battery ejection system is disclosed preferably, though not limiting, for Travel Bags having removable batteries and internal electrically powered components. The holding or latching system allows access to the battery by the user at those times where the user wants to keep the battery within the Travel Bag as well as an ejection system so that the battery can be removed by the user for use of the battery outside the Travel Bag and/or for recharging of the battery. In addition, the rechargeable battery that is providing power to any electrical components within the Travel Bag, such as a vacuum pump, preferably can be held in position so that the electrical connections from the battery to the electrical components are held firmly in place to provide the required firm electrical connection that permits operations by internal electrical components such as a vacuum pump. The novel battery latching system disclosed herein seats the battery in a spring loaded cradle which when depressed keeps the battery in good contact with the POGO pins (or other means of maintaining a firm electrical connection contact) as the connection points for the wiring of the internal electrical components and where a fastening latch at the top of the battery holds the battery down in its cradle and against the spring tension. When the latch is released by the user, the spring tension in the cradle will release and that action will both disconnect the battery from the internal electrical connections and will lift or move the battery into a position above the battery opening where the battery can be grasped by the user and removed from the interior of the Travel Bag. When the user reinserts the battery back into the Travel Bag, it will be spring loaded in place, held in contact with any POGO pins or similar electrical connections, and the latch will hold the battery in this internally secured and functional position.

Rechargeable electronic devices and rechargeable batteries often require a direct plug in connection with wall electrical sockets to accomplish recharging. The recharging cord for these devices or batteries consists of a connector end and a length of electrical cord which contains the wires through which electricity flows to accomplish the recharging and a "male" plug that can be seated to a wall electrical plug receptacle. Travel Bags which contain rechargeable batteries have a required electric plug in and power cord with a recharging end (typically a USB connection but the interface can be other charger endings). Another novel device of this disclosure provides for a plug in recharging power cord where the wire can retract into a small holder with rewinding and extension capabilities and which can keep the entire power cord protected and well organized with no loose lengths of wire. The retracted power cord can be better suited for stowage or carrying by the user and provides a functional and an aesthetic alternative to loose or disorganized charging cord wires. Thus, a novel retractable power cord for charging or recharging batteries or electrical devices is provided and uses a storage case and a retraction system (hereafter "the Retraction Case") which will hold the wires to the plug-in end and the recharging interface in a small and organized wound up position, and which will release to different lengths selected by the user when the user wishes to extend the plug in and recharging cord to reach between the power source and the battery or electrical device being recharged. The mechanism for retraction can allow the user to select the "stopping point" at any point between the fully retracted starting position and the fully extended length of the recharging cord. This retractable power cord device permits the organized stowage of the length of charging cord wire when the same is not in use for recharging.

A Detachable Compression Cap for connecting the vacuum tube which is connected to the vacuum pump with the valve of the vacuum compression bag (hereafter "VCB") can be an integral part of the internal vacuum compression system within a Travel Bag. The detachable compression cap permits the user to connect the vacuum pump tube to the valve of the VCB. When the compression cap is attached to the VCB valve, the vacuum pump can extract air from the VCB. The compression cap can remain connected with the VCB valve and the connection can be substantially air tight so that there is no back flow of air into the VCB and so that the partial vacuum inside the VCB is maintained. When the compression cap is detached from the valve the valve can still retain its capability to prevent a back flow of air from the external atmosphere into the VCB. A detachable compression cap will permit the user to use the vacuum pump to evacuate air from additional VCBs which contain a valve, each of which connects to the detachable compression cap. Thus, this additional novel device disclosed herein provides for a detachable compression cap to connect a vacuum pump with the valve of a VCB. A Detachable Compression Cap for connecting the vacuum tube which is connected to the vacuum pump with the valve of the VCB can be an integral part of the internal vacuum compression system within a Travel Bag. The detachable compression cap permits the user to connect the vacuum pump tube which conveys extracted air from the VCB through the valve of the VCB to the vacuum pump which expels the extracted air to the atmosphere. The user can keep the compression cap in position or can detach the compression cap from the VCB valve. The VCB valve has a back check component/back check valve which prevents the back flow of air from the exterior of the VCB to the interior of the VCB.

When the compression cap is attached to the VCB valve, the vacuum pump can extract air from the VCB. The compression cap can remain connected with the VCB valve and the connection can be substantially air tight so that there is no back flow of air into the VCB and so that the partial vacuum inside the VCB is maintained. When the compression cap is detached from the valve the valve will retain its capability to prevent a back flow of air from the external atmosphere into the VCB. A detachable compression cap can permit the user to use the vacuum pump to evacuate air from additional VCBs which contain a valve each of which connects to the detachable compression cap. The Detachable Compression Cap attaches to the VCB valve which may be located in different positions of the VCB.

BRIEF DESCRIPTION OF THE DRAWINGS

FIG. 7A shows a Retractable Battery Cover activating the retracted/release position or the placement of the Battery Latch in its closed and latching position in accordance with one embodiment of the present disclosure;

FIG. 7B shows a cross section drawing of the component parts of the Retractable Battery Cover and the spring loaded Battery Latch and with the Retractable Battery Cover in a fully closed position in accordance with the present disclosure;

FIG. 7C shows a cross section drawing of the component parts of the Retractable Battery Cover and the spring loaded Battery Latch and with the Retractable Battery Cover in a closed position to cover to hid the opening where the battery is inserted and with the battery catch maintaining the battery in its inserted position in accordance with the present disclosure;

FIG. 7D shows a cross section drawing of the component parts of the Retractable Battery Cover and the spring loaded Battery Latch and with the Retractable Battery Cover in an open position which reveals the battery and user interface preferably at the top of the battery, while still allowing the battery catch to maintain the battery in its inserted position in accordance with the present disclosure;

FIG. 7E shows a cross section drawing of the component parts of the Retractable Battery Cover and the spring loaded Battery Latch and with the Retractable Battery Cover in a fully open position pressing against the spring which previously provided closing force to the Retractable Battery Cover (see FIG. 7C) in accordance with the present invention;

DETAILED DESCRIPTION

Figure 1A:
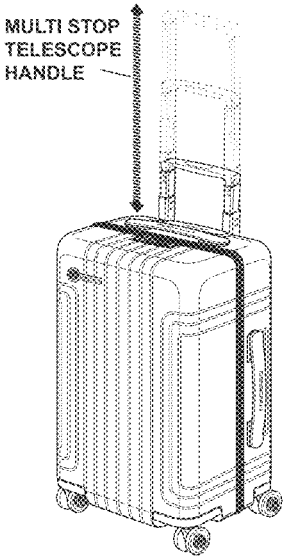
FIG. 1A illustrates a non-limiting example of a hard shell suitcase with a retractable trolley having multi-stop trolley extensions from a fully closed position to a fully extended position in accordance with the present disclosure.
Figure 1B:
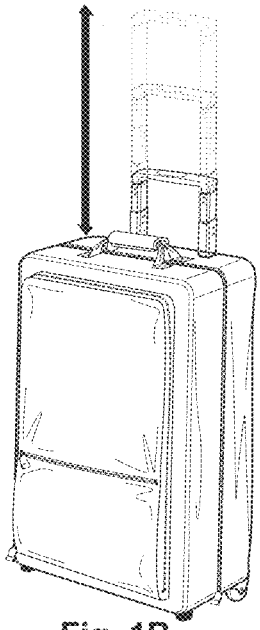
FIG. 1B illustrates a non-limiting example of a soft shell suitcase with retractable trolley having multi-stop trolley extensions from a fully closed position to a fully extended position in accordance with the present disclosure.
Figure 1C:
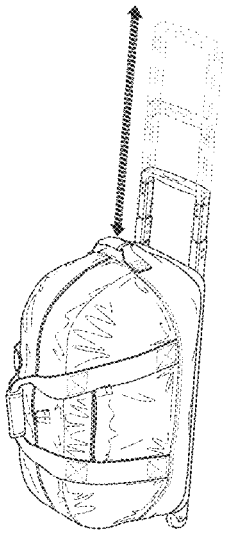
FIG. 1C illustrates a non-limiting example of a wheeled duffle bag with retractable trolley having multi-stop trolley extensions from a fully closed position to a fully extended position in accordance with the present disclosure.
Figure 1D:
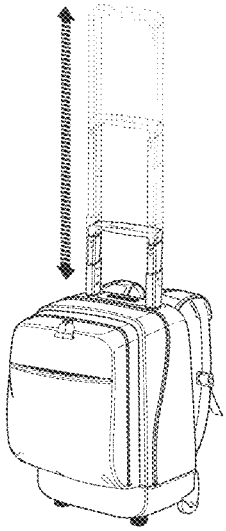
FIG. 1D illustrates a non-limiting example of a wheeled back pack with retractable trolley having multi-stop trolley extensions from a fully closed position to a fully extended position in accordance with the present disclosure.
Figure 1E:
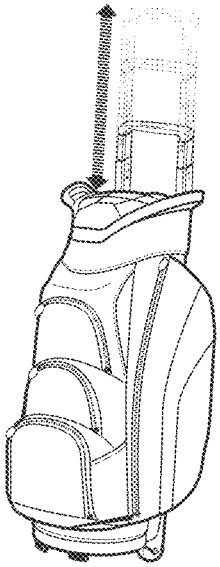
FIG. 1E illustrates a non-limiting example of a wheeled golf bag with retractable trolley having multi-stop trolley extensions from a fully closed position to a fully extended position in accordance with the present disclosure.
Figure 1F:
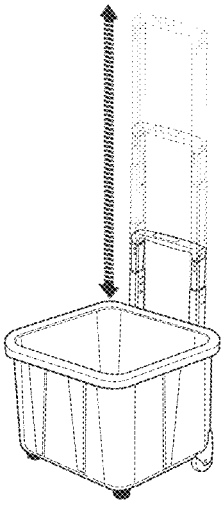
FIG. 1F illustrates a non-limiting example of a wheeled case with retractable trolley having multi-stop trolley extensions from a fully closed position to a fully extended position in accordance with the present disclosure.
Figure 1G:
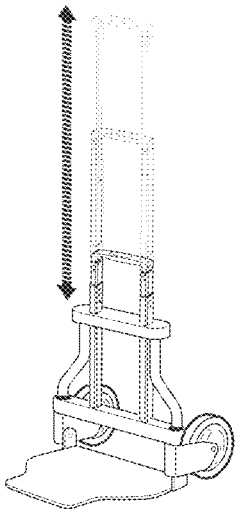
FIG. 1G illustrates a non-limiting example of a two wheeled hand cart with retractable trolley having multi-stop trolley extensions from a fully closed position to a fully extended position in accordance with the present disclosure.
Figure 1H:
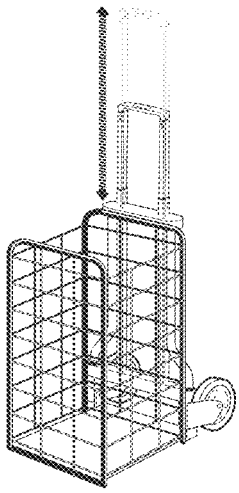
FIG. 1H illustrates a non-limiting example of a wheeled open shopping cart with retractable trolley having multi-stop trolley extensions from a fully closed position to a fully extended position in accordance with the present disclosure.
Figure 1I:
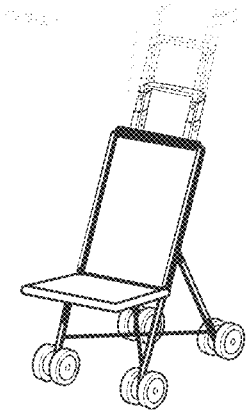
FIG. 1I illustrates a non-limiting example of a wheeled stroller with retractable trolley having multi-stop trolley extensions from a fully closed position to a fully extended position in accordance with the present disclosure.
Figure 1J:
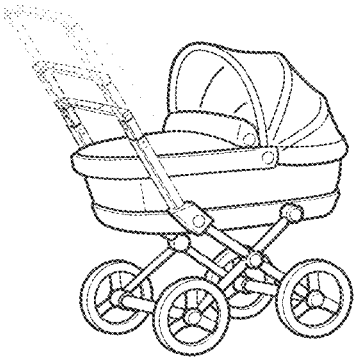
FIG. 1J illustrates a non-limiting example of a wheeled baby carriage with retractable trolley having multi-stop trolley extensions from a fully closed position to a fully extended position in accordance with the present disclosure.

Definition of travel bag applicable to all Disclosures: Travel bags are defined in this application as Travel bags of all types (including without limitation hard shell and soft shell travel bags of all sizes, luggage of all sizes, duffle bags of all sizes, travel bags of all sizes, backpacks of all sizes, and other portable hard shell or soft shell containers of all sizes (collectively hereafter: "travel bag" or "travel bags.").

FIGS. 1 through 3 illustrates the novel retractable trolley having multiple adjustable handle heights which can be used with various travel bags and other movable items such as carriages, carts, etc.

Definition of trolley handle: The uppermost part of a trolley by which the user holds onto the trolley structure and pulls or pushes the trolley. This can be a fixed bar across the top of the trolley structure or a handle fashioned to be gripped by a human hand or human hands.

Definition of telescoping trolley: A trolley structure which has one or more telescoping sections and preferably two or more telescoping sections which permit the movement of the smaller interior sections within the larger exterior sections. This function permits the trolley structure to be extended to a greater height than a single section. This function permits the trolley structure to be retracted into a structure that is the height of a single telescoping section.

Definition of wheeled case: any configuration of a human operated wheeled system where the user can apply leverage to the carrying or transportation of objects. Examples of wheeled cases which include the subset of wheeled travel bags and other wheeled items shown in FIGS. 1A through 1J.

Definition of adjustable height for telescopic retractable trolley handles: a trolley structure which can preferably permit more than three positions for the extended telescoping trolley where the user can select the height of the trolley pull handle.

Definition of fixing object and position pad receptacle: the fixing object (that which fixes the extension selection) which is released by the user which when positioned against the position pad receptacle (the holder of the fixing object) holds the adjustable trolley structure in place.

For this embodiment, handles can be used to pull or to push Wheeled Cases or the subset of Wheeled Cases known as Travel Bags and other wheeled items like, without limitation, carriages and carts. When the handles are fastened to bars or tubes which have the ability to be adjusted within a trolley structure, they become telescoping retractable trolley pull handles. The selection of heights of the pull handle are presently limited to a few preset positions in current designs. The disclosed embodiment provides for a much greater number of fixing points along the range of the height of the handle to any point between the closed trolley position and the fully extended trolley position to allow the trolley height to be more specific and accurate to the height of the user.

Current telescoping retractable trolley pull handles can comprise 1) a base which seats the lower section of aluminum or similar metal tubes, 2) a lower section of the telescoping tube which remains fixed on the exterior or the interior of the Wheeled Case or Travel Bag and which contain the upper stage two or stage three sections of telescoping tubes, 3) a handle at the top which the user uses to pull or push a Wheeled Case or a Travel Bag, 4) end caps or guides which guide the second or third stage telescoping tubes as they are being extended or retracted, 5) spring loaded fixing objects to hold the second or third stage tubes in place or to release them when the second or third stage tubes are being closed down, 6) a control button (usually in the handle) which is attached through a series of levers to release a position pin and to insert the position pin into the position pad receptacle held in place within the second or third stage trolley tubes designed to hold the trolley assembly at that selected height of the fixing object and to release the fixing object from the position pad when it is time to return the telescoping tubes to their closed position within the wheeled case or the travel bag.

The novel trolley disclosed herein provides for a position pad receptacle to provide for a multi-stop telescoping tube which can be engineered or designed to provide multiple places for the position pin to be temporarily engaged to hold the selected trolley handle height in place. The position pin can be controlled by the user depressing the control button in the pull handle and the user can select the height of the pull handle by releasing the control button of the position pin at the desired height. The position pin or position pad holds the multi-stop plurality of telescoping tubes in place. When the user wishes to change the trolley handle height or to return the trolley handle to its fully retracted closed position, the user holds down the control button and slides the telescopic tubes to the desired end position. The release of the control button fixes the position pin or position pad in contact with the position pad receptacle at that new position.

FIGS. 1A through 1J illustrate the novel multi adjustable handle height trolley system being used with the following non-limiting examples: hard shell suitcase, soft shell suitcase, wheeled duffle bag, wheeled back pack, wheeled golf bag, wheeled case, two wheeled hand cart, wheeled open shopping cart, wheeled stroller, and wheeled baby carriage.

Figure 2A:
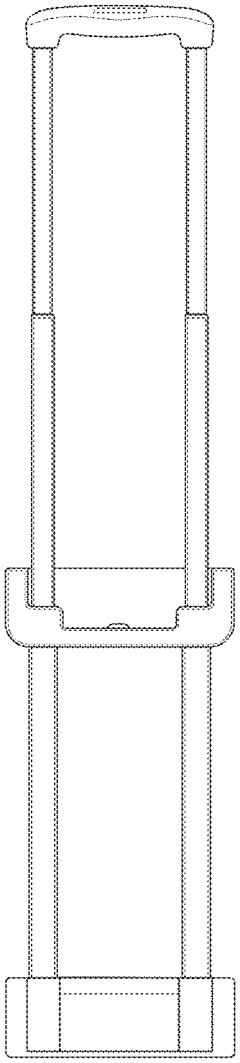
FIG. 2A is a front view of a multi-stop telescopic retractable trolley pull handle at full height extension in accordance with the present disclosure.
Figure 2B:
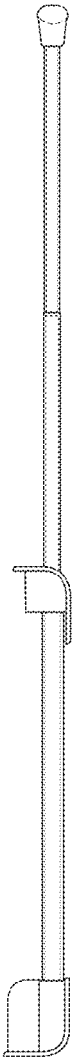
FIG. 2B is a side view of the multi-stop telescopic retractable trolley pull handle at full height extension.
Figure 2C:
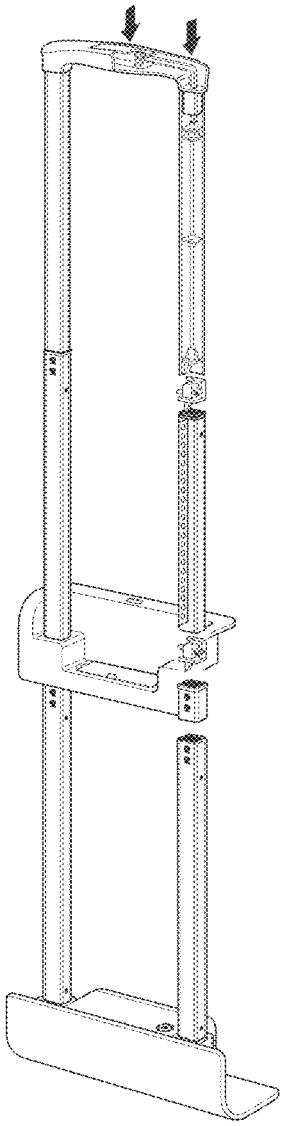
FIG. 2C is an oblique angled front view of the multi-stop telescopic retractable trolley pull handle at full height extension showing the back of base and outside view of the trolley bridge in accordance with the present disclosure.
Figure 2D:
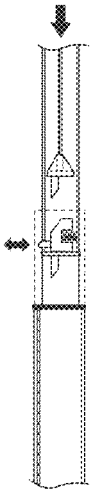
FIG. 2D is an oblique angled front view of the multi-stop telescopic retractable trolley pull handle at full height extension showing interior of base and interior view of trolley bridge in accordance with the present disclosure.
Figure 2E:
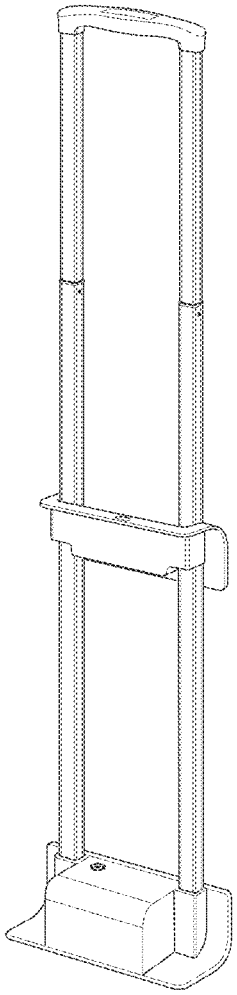
FIG. 2E is an oblique angled front view of the multi-stop telescopic retractable trolley pull handle at example half height extension showing potential upward and downward movement of pull handle and telescoping tubes in accordance with the present disclosure.
Figure 2F:
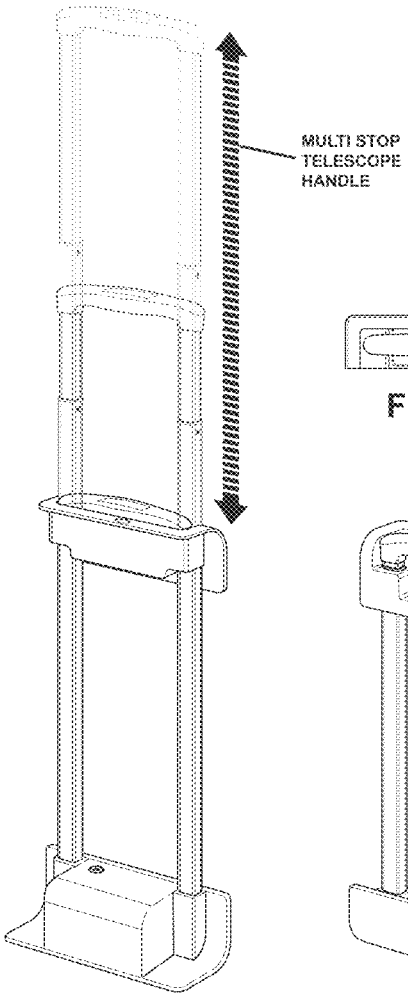
FIG. 2F is an oblique angled front view of the multi-stop telescopic retractable trolley pull handle at full retraction (closed position) in accordance with the present disclosure.
Figure 2G:
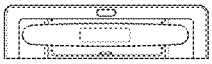
FIG. 2G is a top view of the multi-stop telescopic retractable trolley pull handle.
Figure 2H:
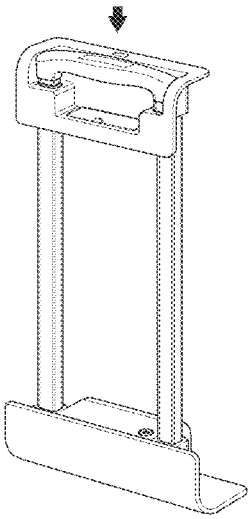
FIG. 2H is a non-limiting example of a placement pin activated by a depression of control button on top of the trolley handle in accordance with the present disclosure.

FIG. 2 shows the novel retractable trolley pull handle in various positions and view, such as, without limitation, at full height extension (FIGS. 2A, 2B, 2C and 2D), at half height extension (FIG. 2E) and at full retraction/closed position (FIG. 2F).

Figure 3A:
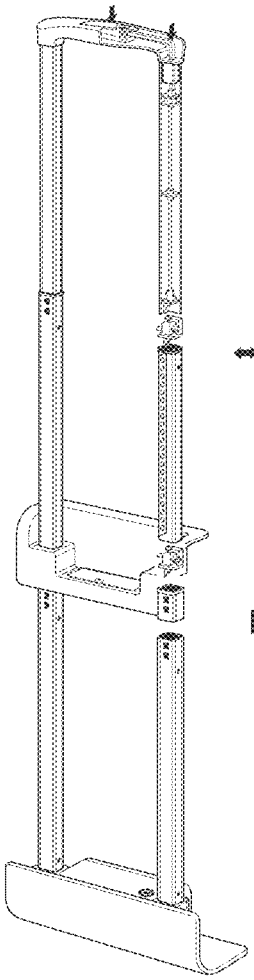
FIG. 3A is a non-limiting example where the fixing pin can be a cylindrical metal pin and the receptacle pad can be a metal strip with closely spaced holes sufficiently large enough to accept the fixing pin insertion in accordance with the present disclosure.
Figure 3B:
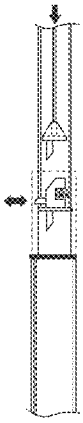
FIG. 3B is closed-up view of a portion of FIG. 3A.
Figure 3C:
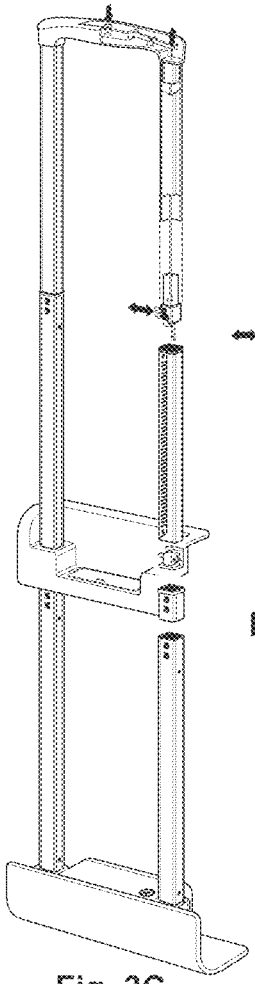
FIG. 3C is a non-limiting example where the fixing pin can be a metal or hard plastic multi-pronged fixing pin and the receptacle pad can be a metal or hard plastic strip with closely spaced protruding leaves large enough to accept the fixing pin insertion in accordance with the present disclosure.
Figure 3D:
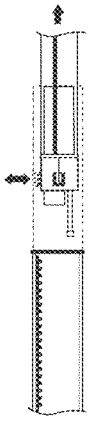
FIG. 3D is a closed-up view of a portion of FIG. 3C.
Figure 3E:
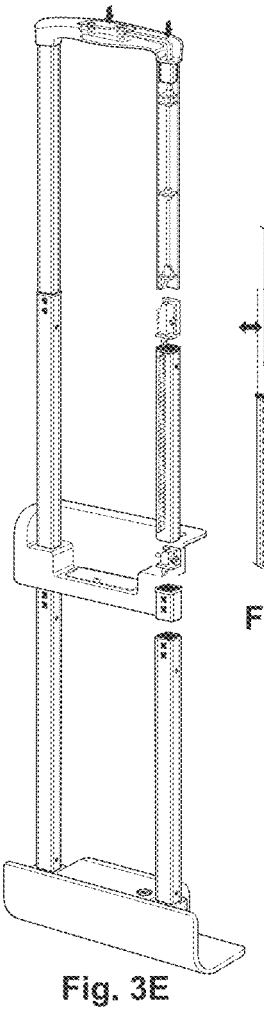
FIG. 3E is a non-limiting example where the fixing pin can be a metal or hard plastic sin curved shape with multiple peaks in the sin curve and the receptacle pad can be a metal or hard plastic strip with closely spaced reciprocal sin curve shapes large enough to accept the fixing pin seating in accordance with the present disclosure.
Figure 3F:
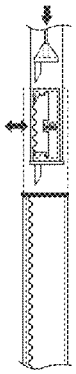
FIG. 3F is a closed-up view of a portion of FIG. 3E.

FIG. 3 shows non-limiting examples of the fixing pins and receptacle pads for the novel retractable telescoping trolly, which can included, without limitation, a cylindrical metal pin and a metal strip receptacle pad with closely spaced holes sufficiently large enough to accept the fixing pin insertion (FIG. 3A), a metal or hard plastic multi-pronged fixing pin and a metal or hard plastic strip receptacle pad with closely spaced protruding leaves large enough to accept the fixing pin insertion (FIG. 3B) and a metal or hard plastic sin curved shape with multiple peaks in the sin curve and a metal or hard plastic strip receptacle pad with closely spaced reciprocal sin curve shapes large enough to accept the fixing pin seating (FIG. 3C).

Figure 4A:
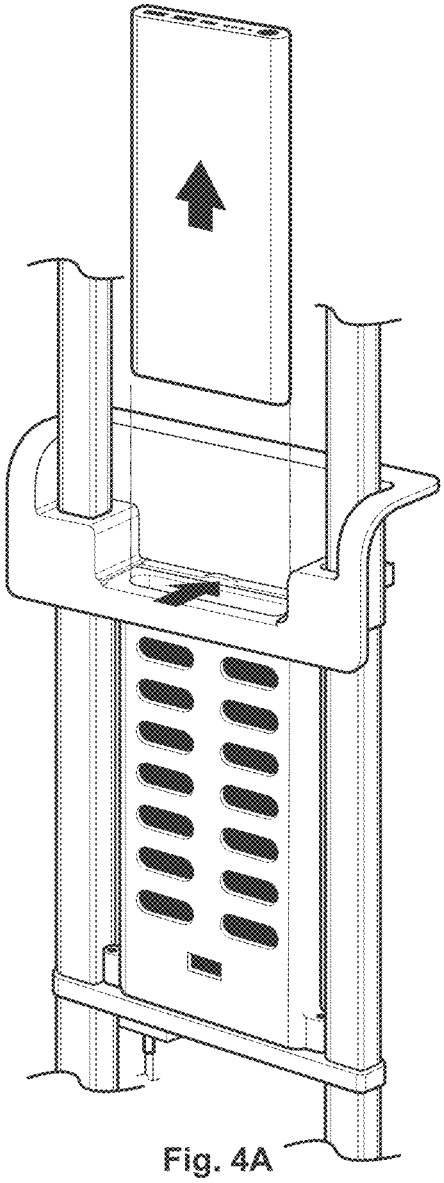
FIG. 4A illustrates a Retractable Battery Cover in its open position within a Trolley Bridge in accordance with the present disclosure.
Figure 4B:
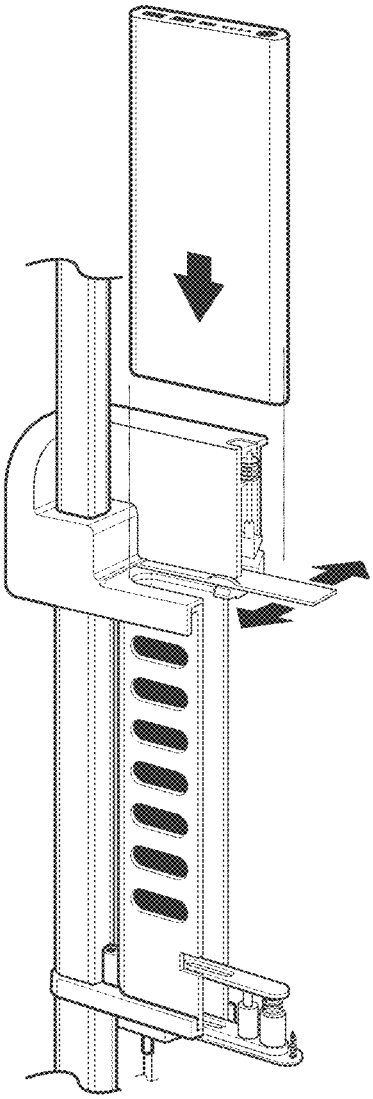
FIG. 4B illustrates a cutaway drawing showing the Retractable Battery Cover in its open position within the Trolley Bridge in accordance with the present disclosure.
Figure 4C:
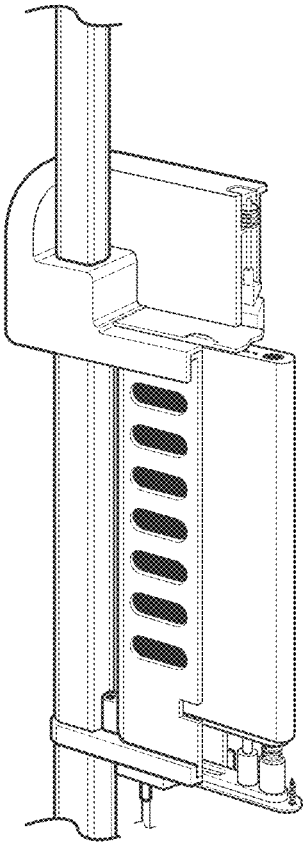
FIG. 4C is a cutaway drawing showing the Retractable Battery Cover in its closed position above the Trolley Bridge in accordance with the present disclosure.

FIGS. 4A through 4C illustrate the novel retractable battery cover disclosed herein, which in one non-limiting embodiment, can be a plastic cover for the battery opening in the bridge portion of the trolley. Travel Bags with removable batteries have the issue of covering and protecting the battery from rain/moisture/dust in the environment on the exterior of the Travel Bag. The disclosed novel retractable hingeless, preferably plastic, cover allows the user to slide the cover into an open or closed position without the cover becoming detached from the Bridge of the Travel Bag. Built in guides for the plastic cover permit the user to open the cover by pushing the cover into the interior of the Bridge of the Travel Bag (through a slot or other opening of a wall portion which leads into the interior). An open cover (i.e. the cover a majority thereof disposed within the interior) permits the removal of the battery from the interior of the Travel Bag or the user's access to the battery for charging or recharging while it is located within the Travel Bag. A portion of the cover that isn't received within the interior can have a top protrusion or other gripping component where the user can contact or grab to pull the cover into a closed position. The top protrusion or other gripping component can also serve as a stop member to prevent the cover from being fully disposed within the interior and unaccessible/unreachable to the user. When the user decides to close the cover, the user slides the cover from within the Bridge of the trolley assembly along the built in guides to bring the cover to fully closed position where it can be held in closed position by built in stops or cover locking strips or a functional plastic click-in-place locking assembly. As the retractable cover is positioned on top of the Bridge the cover remains substantially above the Bridge battery opening (which is disposed lower within the bridge) and is not substantially flush with the Bridge battery opening.

When the Retractable Battery Cover is in its open position within the Trolley Bridge (FIG. 4A); the battery is accessible and removable by the user through the battery opening in the Trolley Bridge. In the cover open position, the battery can also be inserted by the user into the battery opening in the Trolley Bridge (FIG. 4B). When the Retractable Battery Cover is in its closed position above the Trolley Bridge (FIG. 4C), the cover can protect the battery and suitcase interior from moisture or dust or debris from or on the exterior of the suitcase.

As discussed more with the novel battery latch release function shown in FIGS. 6 and 7, the disclosed novel Retractable Battery Cover may provide a Battery Latch release function. In this configuration the Retractable Battery Cover can provide a dual use function of covering the battery opening of the bridge and participating in the latch release and locking function to hold the battery in place or to release the battery for removal by the user.

Figure 5A:
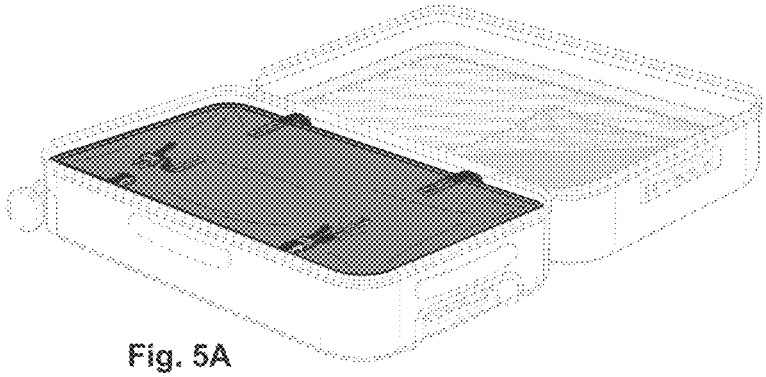
FIG. 5A illustrates a novel divider in its final intended use by user to hold clothing or other packed items in place by the user tightening the adjustable straps of the squeeze buckles in accordance with the present disclosure.
Figure 5B:
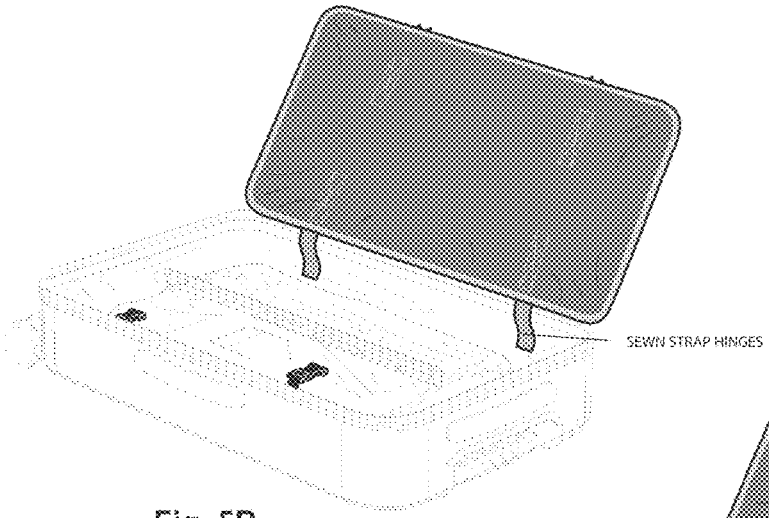
FIG. 5B shows the divider that can be nonremovable from the suitcase interior in accordance with the present disclosure.
Figure 5C:
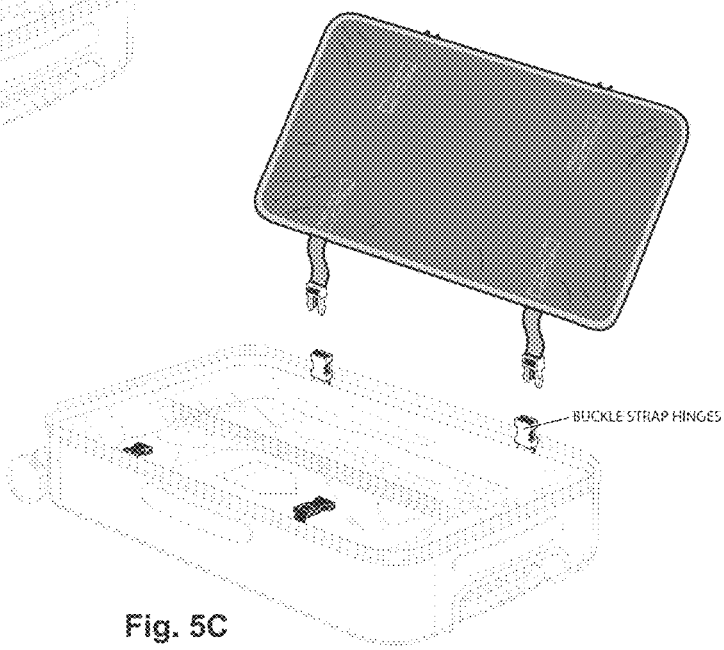
FIG. 5C shows the divider that can be is removable from suitcase interior in accordance with the present disclosure.

FIGS. 5A, 5B and 5C illustrate the novel travel bag divider which can be preferably provided with squeeze buckle fasteners with adjustable straps. The Travel Bag divider can be used to separate the top and the bottom halves of the shell or outer sides of the Travel Bag. The disclosed divider implements or incorporates a novel divider fastening system using buckles or clips, such as, not limited to, plastic squeeze buckles or plastic fastening clips onto a Travel Bag divider to permit the fastening of the divider by the squeeze buckles or fastening clips to the interior side of the Travel Bag. The fastening clips can be secured by sewing or similar means on the side of the Travel Bag and preferably no more than half way across the divider. The preferred connection point of the fastening clips can be near the outer edge of the travel bag and preferably not in the middle of the divider. The fastening clips can be opposite the hinged portion of the divider. The hinged portion of the divider can be attached to the inner portion of the Travel Bag in a manner that permits the divider's movement to an open or closed position by the user. The hinged side of the divider can be attached to the inner portion of the Travel Bag so as to be non-removable by the user or may be connected by squeeze buckles or fastening clips to make the Divider removable by the user. The plastic squeeze buckles or fastening clips may be adjustable from the side fastening clips or the fastening clips attached to the divider itself. The fastening clips may have adjustable straps by which the user can pull the clips closer together. The user's adjustment of the adjustable straps permits the user to secure or to snug up the contents of the Travel Bag that have been packed beneath the divider and to prevent movement of packed items. The end result is that packed contents beneath the divider can be kept in a fixed and snug position within the Travel Bag.

FIG. 5A shows the divider in a final intended use position holding clothing or other packed items in place by the user tightening the adjustable straps of the squeeze buckles. FIG. 5B shows an embodiment where the Divider can be unremovable from the suitcase interior and showing the hinge straps preferably sewn into place such that they are also unremovable by the user. Squeeze buckles can be attached to the opposite suitcase side and can have adjustable straps for the user to snug up (i.e. tighten) the divider as desired. FIG. 5C shows a removable divider that can be removed from the suitcase interior and showing the hinge straps having a squeeze buckle connection to attach both ends of the divider hinges. Squeeze buckles can be attached to the opposite suitcase side and can have adjustable straps for the user to snug up (i.e. tighten) the divider as desired.

FIGS. 6 and 7 illustrate the disclosed novel battery ejection system for the Travel Bags having removable batteries and/or internal electrically powered components. The removable battery provided for the Travel Bags contains a novel holding or latching system so that the battery can be accessed by the user where the user wants to keep the battery within the Travel Bag as well as an ejection system so that the battery can be removed by the user from within the Travel Bag for use of the battery outside the Travel Bag or for recharging (though it is also within the scope of the disclosure that the battery can also be recharged when it is received and positioned within the Travel Bags). The rechargeable battery can provide power to any electrical component within the Travel Bag, such as a vacuum pump/vacuum pump system and in such use the battery can be held in position within the Travel Bag so that the electrical connections/contacts from the battery to the electrical components are held firmly in place to provide an optimal electrical connection.

The disclosed novel battery latching system seats the battery in a spring loaded cradle which when depressed keeps the battery in good contact with the POGO pins as the connection points for the wiring of the internal electrical components and where a fastening latch at the top of the battery holds the battery down in its cradle and against the spring tension. When the latch is released by the user, the spring tension will release and will lift or move a portion of the battery into a position above the battery opening where the battery can be grasped by the user and removed from the interior of the Travel Bag. When the user reinserts the battery back into the Travel Bag, the springs will be compressed and the battery will be spring loaded in place by the latch and held in contact with any POGO pins. Accordingly, the latch holds the inserted battery in its internally secured and functional position.

There can be two non-limiting embodiments for the operation of the Battery Latch. The first non-limiting embodiment can provide for a latch that is retracted or released by a control button on top of the Bridge of the Travel Bag (See FIGS. 6A-6C). The second non-limiting embodiment provides for the Retractable Battery Cover to also have control over the Battery Latch by the complete opening, the partial opening, or the closing of the Retractable Battery Cover (See FIGS. 7A-7E).

In the second non-limiting latch control embodiment, the Retractable Battery Cover 300 activates the retracted/release position or the placement of the Battery Latch 310 in its closed and latching position. The Battery Latch 310 can be spring activated (see spring 312) to push the Battery Latch 310 into place which is its default position. The Battery Latch 310 holds the battery 460 in its intended functional position where the battery 460 is firmly attached to the electrical connections and is held down against the opposing spring activated battery cradle 500.

The retraction or opening of the Retractable Battery Cover 300 pushes the Battery Latch 310 away from the battery opening 702 of the Trolley Bridge area 700, thereby releasing the force of the spring-loaded battery cradle 500 which moves the battery 460 upwards and through the battery opening 702 (similar in effect to toast popping up from a toaster.) When the Battery Latch 310 is thus released the upper part of the battery 460 is above the battery opening 702 in the Bridge area 700 and the battery 460 can be grasped and removed by the user. Insertion of the Battery 460 back into the battery holding area or holder 480 and resuming normal battery 460 functions is accomplished by a reversal of these actions.

When the Retractable Battery Cover 300 position places the Battery Latch 310 into its hold down position and with the Retractable Battery Cover 300 partially open, the user interface 470 on top of the battery 460 is available for use by the user, or the Retractable Battery Cover 300 can be fully closed to seal the battery opening 702 shut against moisture, dust or other outside conditions.

Figure 6A:
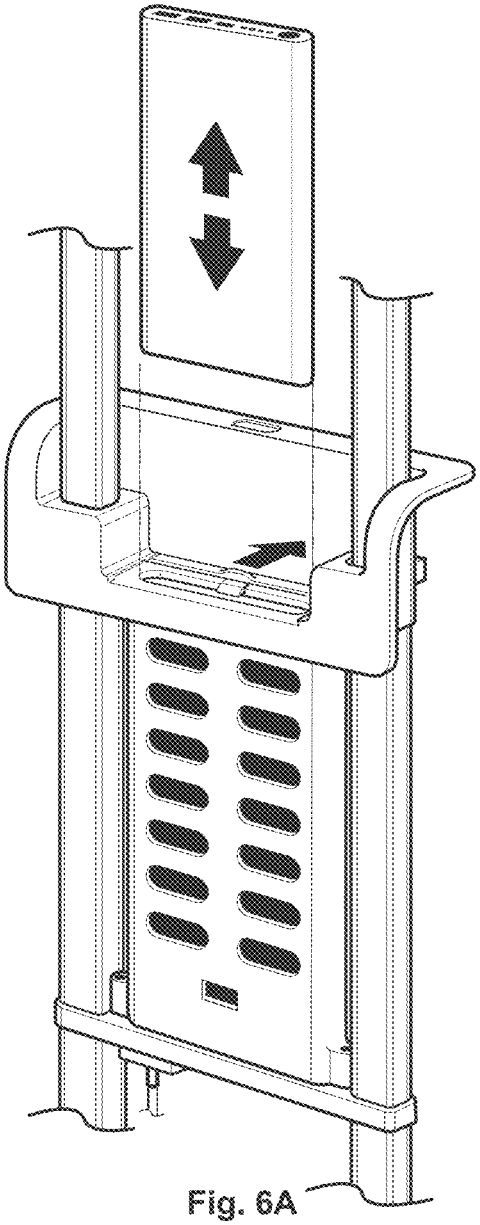
FIG. 6A shows a non-limiting desired function of opening the Retractable Battery Cover to permit the insertion or the removal of a Rechargeable Battery in accordance with the present disclosure.
Figure 6B:
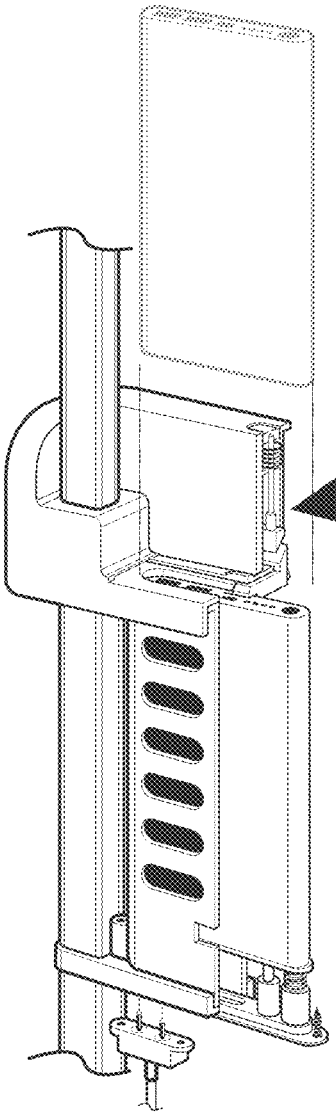
FIG. 6B shows a battery cradle with springs which are compressed by the battery latch and showing possible electrical connections to connect a rechargeable battery with an internal vacuum pump in accordance with the present disclosure.
Figure 6C:
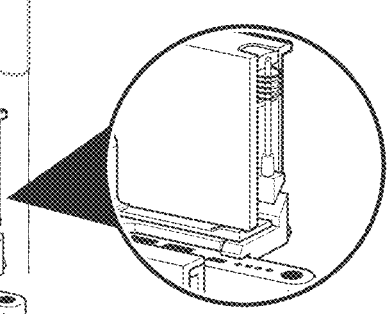
FIG. 6C shows the Battery Latch being retracted by pressing down on a control button on top of the Bridge in accordance with one embodiment of the present disclosure.

FIGS. 6A through 6C illustrate the first non-limiting latch embodiment. With the Retractable Battery Cover in an open position, the rechargeable battery can be inserted or removed from the battery opening/passageway (FIG. 6A). FIG. 6B shows via its cutaway portion, the battery cradle with springs which are compressed by the battery being held down by the latch and showing possible electrical connections such as POGO pins which serve to connect the rechargeable battery with the internal vacuum pump or other electrical components internal to the Travel Bag. The function of the Battery Latch is to hold the battery firmly against both the spring loaded cradle and the electrical connections for operating the internal vacuum pump/other electrical component. The electrical connection shown in this drawing is a POGO pin arrangement that can be fixed to the bottom of the battery case. However, other contact pins and other electrical connections can also be provided and/or use and are considered within the scope of the disclosure. The release of the Battery Latch will permit the spring loaded cradle to release the battery similar to toast popping up out of a toaster so that the battery can be grasped and removed by the user.

FIG. 6C shows how the Battery Latch can be retracted in the first embodiment. When it is desired to remove an inserted battery, the retractable cover can be preferably moved to an open position. However, the retraction of the latch as described below for the first embodiment, can be activated also with the cover in a closed position, which will cause the battery to pop up and make contact with a bottom surface of the cover. Assuming that the cover is in an open position, by pressing down on a control button preferably located on a top area of the Bridge (though such is not considered limiting) an internal spring can be compressed and a lower contact member (preferably having an angled side) makes contact with a contact portion (preferably also having an angled side corresponding to the angled side of the lower contact member) associated with a battery latch that is currently maintaining the battery in position. The contact between the lower contact member and the contact portion of the latch, causes the latch to lift up and/or away at a sufficient distance to allow the battery to be released (i.e. unlatched) and thus causing the battery to pop up as the cradle spring(s) are allow to extend as they are no longer being compressed by the latch holding the battery down. When the button is no longer pressed by the user, the internal spring that is positioned between an internal shelf and a bottom surface of the button is allowed to extend to position the button into it's upright (i.e. unpressed) position. The lower contact member can be connected to the bottom surface of the button by a rod or other cylindrical or elongated member. Whatever elongated member choses, such member preferably can also extend through the center passageway of the internal spring. Thus, in the first embodiment for the latch retraction to allow the battery to be removed, the user preferably activates or releases the Battery Latch by pressing down on the control button preferably located on a top area of the Bridge.

In one embodiment, the pressing of the button causing the contact portions to mate can cause a pivoting/rotating away movement of the latch when releasing the battery. Alternatively, the latch can be move straight up and away from the battery. In either non-limiting button pressing embodiment, the upward force of the battery from the release of the one or more springs in the cradle area pushing on the bottom of the battery, can move the battery upward sufficient enough, such that when the button is no longer pressed, the latch contacts the side of the battery (if it contacts the battery at all) in a harmless manner (i.e. doesn't relatch the battery back down again) and the battery remains easily removed by the user. Preferably, only when the user reinserts the battery with enough force to compress the spring(s) in the cradle area, will the latch be permitted to make contact with the upper surface of the battery to maintain the battery in such position.

FIGS. 7A-7E illustrate the second non-limiting battery latch retraction embodiment. As seen in FIGS. 7A and 7B, the Retractable Battery Cover or Door 300 is in an open position, while the latch or catch 310 remains holding the inserted battery 460 downward in the battery holding area 480, such that the battery 460 remains electrically connected with the internal electrical component (e.g. vacuum pump), while allowing access to the user to the ports and/or other controls on the top of the battery 460, such that the ports/controls (collectively interface 470) are accessible to the user (i.e. for charging another electrical device such as a smart phone in one non-limiting example). The position of the cover 300 and the latch 310 in FIGS. 7A and 7B is also seen in FIG. 7D. Thus, in these positions for the cover 300 and latch 310, the cover 300 can be considered in its open position, while the latch 310 can be considered to be in its closed and latching position.

In the second embodiment, the Battery Latch can be preferably spring 312 activated to push the Battery Latch 310 into place which can be considered its default position (i.e. closed position). The Battery Latch 310 holds the battery 460 in its intended functional position where the battery 460 is firmly attached to the electrical connections and is held down against the opposing spring activated battery cradle 500 (i.e. one or more springs 510 located at the bottom of the battery cradle 500 are compressed). Preferably, at least a portion of the bottom of the battery cradle 500 can be opened (see opening 520) to allow the contacts/electrical connections on the bottom of the battery to make contact/be connected with the contacts/electrical connections 600 of the internal electrical component (i.e. vacuum pump disposed internally within the Travel Bag). As seen in FIG. 7D, additional space is available for the cover to move further within the interior 700 of the Trolley Bridge.

As best seen in FIG. 7E, when the user pushes the cover 300 further in (e.g. pushes against a handle portion or protrusion or tab 314 extending upward from the cover member 300 with enough force to overcome the force of the spring 312 pushing the latch 310 over the battery 460, the cover 300 moves further inward and latch 310 also moves inward (i.e. the latch spring 312 is compressed) in order to release the battery 460 and allow it to pop up (i.e. the spring(s) 510 at the bottom of the cradle 500 are permitted to extend up). Accordingly, the further retraction or opening of the Retractable Battery Cover 300 also pushes the Battery Latch 310 away from the battery opening 702 of the Bridge, thereby releasing the force of the spring-loaded battery cradle 500 which moves the battery upwards and an upper portion of the battery 460 through the battery opening 702. When the Battery Latch 310 is thus released the upper part of the battery 460 is above the battery opening 702, preferably still in the Bridge area 700, and the battery 460 can be grasped and removed by the user.

Insertion of the Battery 460 back into the battery holding area 480 and resuming normal battery functions is accomplished by a reversal of these actions. When the Retractable Battery Cover 300 position places the Battery Latch 310 into its hold down position and with the Retractable Battery Cover 300 partially open (FIG. 7D), the user interface 470 on top of the battery 460 is available for use by the user, or the Retractable Battery Cover 300 can be fully closed to seal the battery opening 702 shut against moisture, dust or other outside conditions (FIG. 7C).

Accordingly, FIG. 7C shows the preferred component parts of the Retractable Battery Cover 300 and the spring-loaded Battery Latch 310 for the second non-limiting latch embodiment and with the Retractable Battery Cover 300 in fully closed position which can seal or virtually seal out moisture, dirt, or other outside conditions and containments. FIG. 7D shows the Retractable Battery Cover 300 in an open position which reveals the battery 460 and user interface 470 where the user can charge or recharge the battery 460 or other electronic components, while the Battery Latch 310 remains holding the battery 460 in place. FIG. 7E shows the Retractable Battery Cover 300 in fully open position pressing against the latch spring 312 which provides closing force to the Retractable Battery Cover 300. The Retractable Battery Cover 300 pushes the Battery Latch 310 against its spring 312 and to a position where the Battery Latch 310 is no longer engaged with the battery 460. When the Battery Latch 310 is not engaged with the battery 460, the potential force in the springs 510 in the battery cradle 500 release and the battery 460 pops up within an upper portion of the battery positioned out of the battery opening 702 and preferably within the Bridge area 700.

For purposes of the latch embodiments in FIGS. 6 and 7, the term "latch" is considered to include any object, protrusion, etc. that can used to contact the top surface of the battery 460 to retain the battery 460 within the Travel Bag and that can be moved away from such position in order to release the battery 460 and to allow the battery 460 to pop up and to allow the top portion of the battery 460 to travel through the battery opening 702 in the bottom surface of the bridge area 700 and to be disposed within the bridge area 700 where the top portion can be grabbed/grasped by the user in order to fully removed the battery 460 from the Travel Bag.

FIGS. 8 and 9 illustrate a novel retraction case preferably having a retractable power cord for charging or recharging batteries and/or other electrical devices. The disclosed power cord provides for charging of rechargeable batteries and other electronic devices providing a proper or correct amount of DC power to the battery or the electronic device for recharging. The length of the power cord can vary. With currently available power cords, it is common for the cord to become tangled or otherwise bend or become disorganized also frequently resulting in the cord becoming damaged. The disclosed power cord addresses these problems.

The connection end of the disclosed novel charging cord used to connect to the electronic device or the battery can be a Universal Serial Bus ("USB") which can be the interface between the charging source and the device being charged. Other connecting ends different from a USB may be affixed depending upon the interface design of the rechargeable battery or electronic device and all are considered within the scope of the disclosure.

A plug in end of the disclosed novel charging cord, may be a two or three plug in prong plug, the plugs may be hinged to provide a flush plug in unit, and the configuration of plugs can differ for different countries or different power settings from the power source. Common features of the disclosed novel power cord system are a plug or connection into the power source (typically a wall plug receptacle providing electricity), a length of cord containing the wires which provide power or other communications functions, and an interface at the end of the power cord for connection to the battery or electrical device being charged/recharged. Depending on the connection ports/outlets and the sources of power, other connection ends can be provided for either the cord or plug of the disclosed novel retractable case and all are considered within the disclosure.

The disclosed storage case is provided with a retraction system (hereafter collectively "the Retraction Case") which can hold the wires to the plug-in end and the recharging interface in a small and organized wound up position, and which can release to different lengths selected by the user when the user wishes to extend the plug in and recharging cord to reach between the power source and the battery or electrical device being charged/recharged. The mechanism for retraction can allow the user to select a "stopping point" at any point between the fully retracted starting position and the fully extended length of the recharging cord. The disclosed novel retractable power cord device permits the organized stowage of the full length of the charging cord wire when the same is not in use for recharging.

In one non-limiting embodiment (FIGS. 8A-8C), the Retraction Case can have a fixed (i.e. non-retractable) plug in end to connect with a wall plug. In a second non-limiting embodiment (FIGS. 9A-9D) the Retraction Case can have two retractable cords, one for the plug in end and the other for the electronic connection end.

Figure 8A:
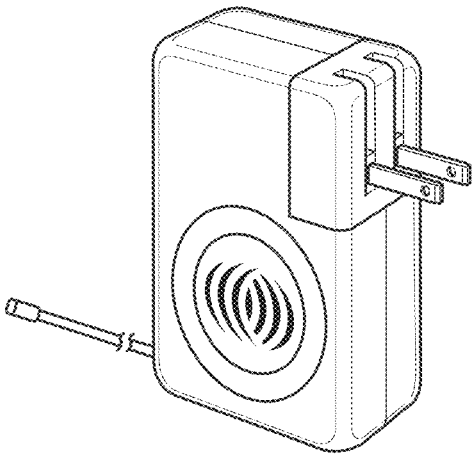
FIGS. 8A, 8B and 8C show a novel Retractable Charging Cord with a Fixed plug end in accordance with the present disclosure.
Figure 8B:
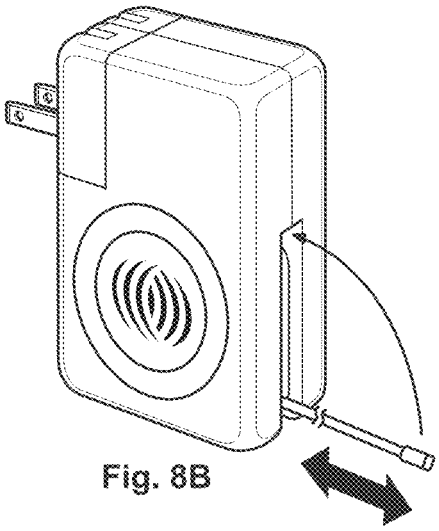
Figure 8C:
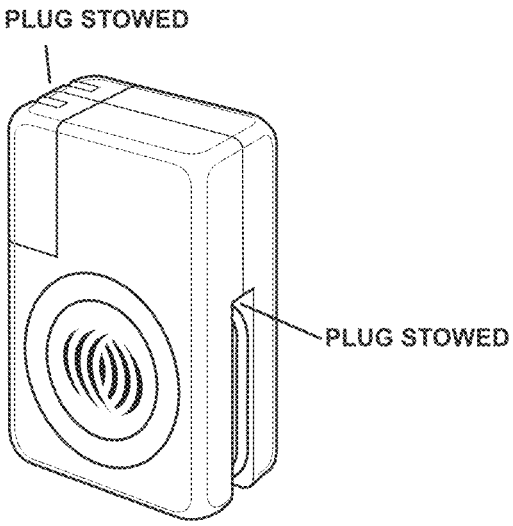

FIGS. 8A-8C illustrate the first embodiment Retractable Charging Cord with Fixed plug end. In this non-limiting embodiment, the plug in portion of the charging cord can be fixed to the retraction case. The charging cord with the battery or electronic device interface is thus the only cord that is extracted from the retraction case for this embodiment. The length of the single charging cord can be variable so as to retract fully into the retraction case when it is to be stored. The plugs of the plug in portion and the plug at the end of the charging cord may be stowed (preferably through rotation or pivoting movement of the plug prongs) in the retractable case cover (See FIG. 8C).

Figure 9A:
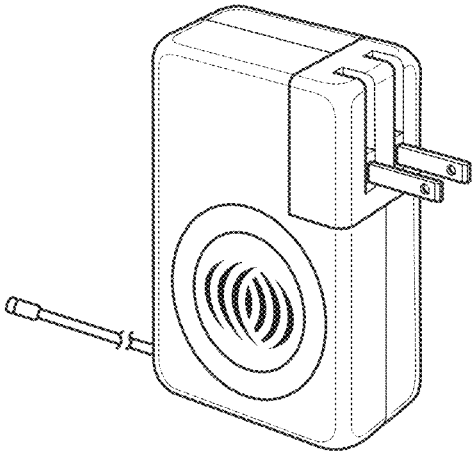
FIGS. 9A, 9B, 9C and 9D show a novel Retractable Charging Cord with both ends retractable to variable lengths in accordance with the present disclosure.
Figure 9B:
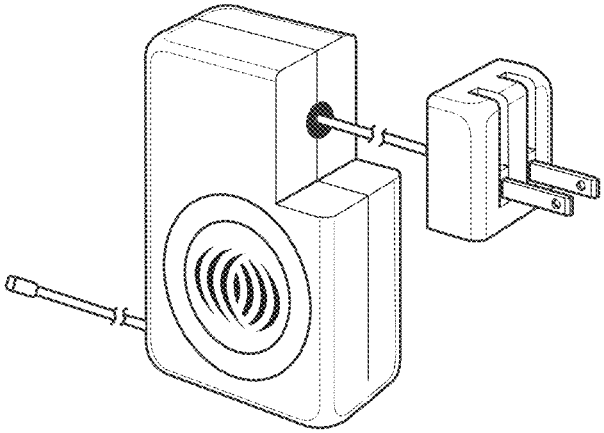
Figure 9C:
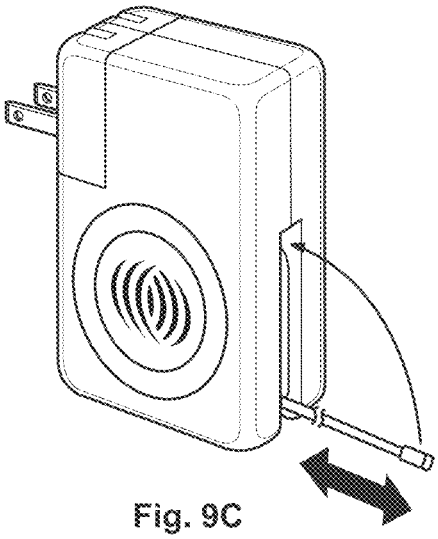
Figure 9D:
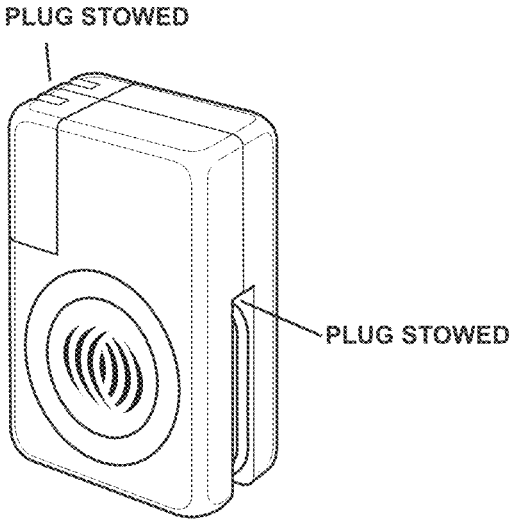

FIGS. 9A-9D illustrate the second embodiment Retractable Charging Cord with both ends retractable to variable lengths. In this non-limiting embodiment, both the charging plug and the battery or electronic device interface can be simultaneously extracted from the retraction case, though the device can be also used where only one (i.e. either the plug or the cord is extended). The lengths of the two cords are variable (and can be the same or one can be longer than the other-either way: plug longer, cord shorter or plug shorter, cord longer) so as to retract fully into the retraction case. The plugs of the plug in portion and the plug at the end of the charging cord may be stowed in the retractable case cover (FIG. 9D).

FIGS. 10-18 illustrate the non-limiting embodiments for a novel detachable compression cap preferably for connecting a vacuum pump with a valve member of a vacuum compression bag. The detachable compression cap for connecting the vacuum tube which is connected to the vacuum pump with the valve of the vacuum compression bag is an integral part of the internal vacuum compression system within a Travel Bag. The compression cap provides an air tight seal to maximize the effectiveness of the vacuum pump extracting air from the interior of the vacuum compression bag.

The detachable compression cap permits the user to connect the vacuum pump tube with valve of the vacuum compression bag, such that the vacuum pump extracts air from within the vacuum compression bag and conveys it to the valve of the vacuum compression bag and into the vacuum pump tube for ultimate release into the atmosphere. The user can keep the compression cap in position or can detach the compression cap from the vacuum compression bag valve. The vacuum compression bag valve can be provided a back check component/valve which prevents the back flow of air from the exterior of the vacuum compression bag to enter within the interior of the vacuum compression bag.

When the compression cap is attached to the vacuum compression bag valve, the vacuum pump can extract air from the vacuum compression bag. The compression cap can remain connected with the vacuum compression bag valve and the connection can be substantially air tight so that there is no back flow of air into the vacuum compression bag and so that the partial vacuum inside the vacuum compression bag is maintained. When the compression cap is detached from the valve the valve can retain its capability to prevent a back flow of air from the external atmosphere into the vacuum compression bag. Thus, the detachable compression cap can permit the user to use the vacuum pump to evacuate air from additional vacuum compression bags through valve members for each vacuum compression bag that can also be connected to the detachable compression cap.

Several non-limiting embodiments can be used for attaching the compression cap to the valve of the vacuum compression bag. The compression cap may be screwed on to mating threads of the valve. Alternatively, the compression cap may be twisted into a locking system on the valve. Further, the compression cap may be snapped and held in place by a press on locking system with the valve. The compression cap can be removed from the valve of the vacuum compression valve by reverse actions to the attachment means. In any of the attachment embodiments, the end result is that the user can connect or disconnect the compression cap in furtherance of their use of the internal vacuum compression pump and vacuum compression bag or bags.

Figure 10:
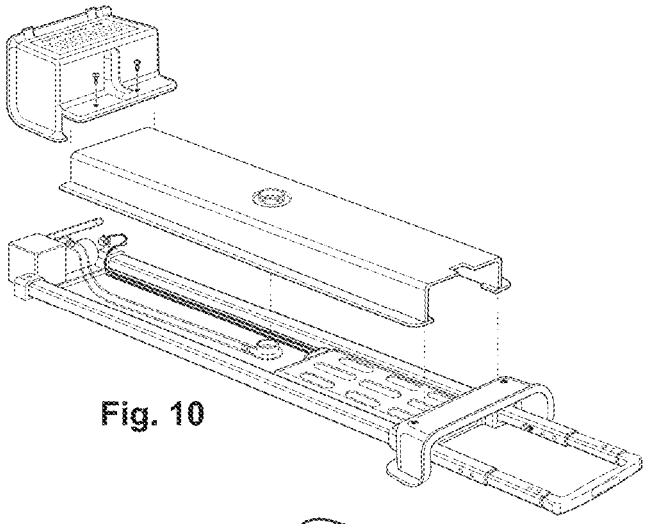
FIGS. 10, 11 and 12 illustrate a Detachable Compression Cap mounted in a trolley assembly in accordance with the present disclosure.
Figure 11:
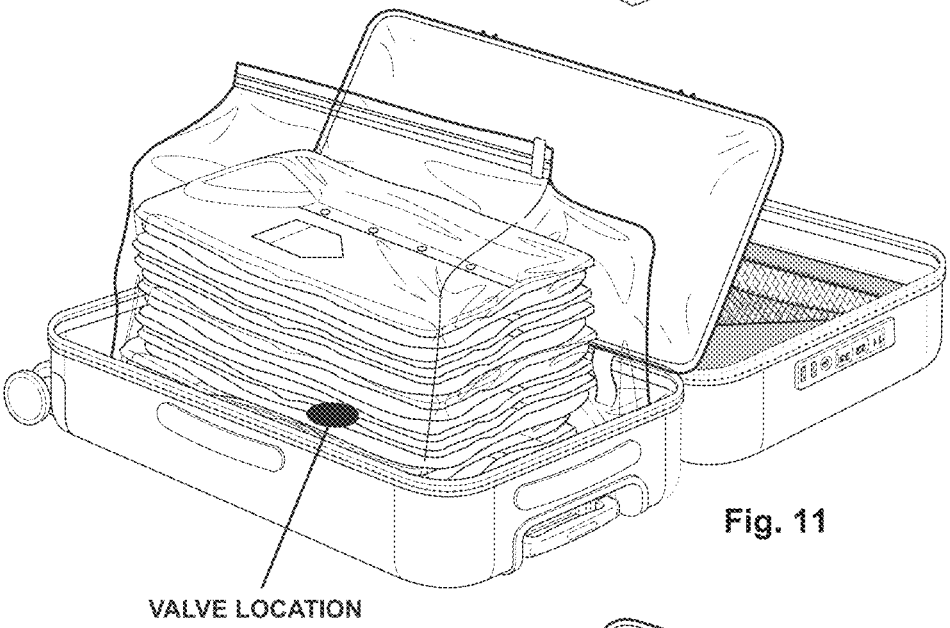
Figure 12:
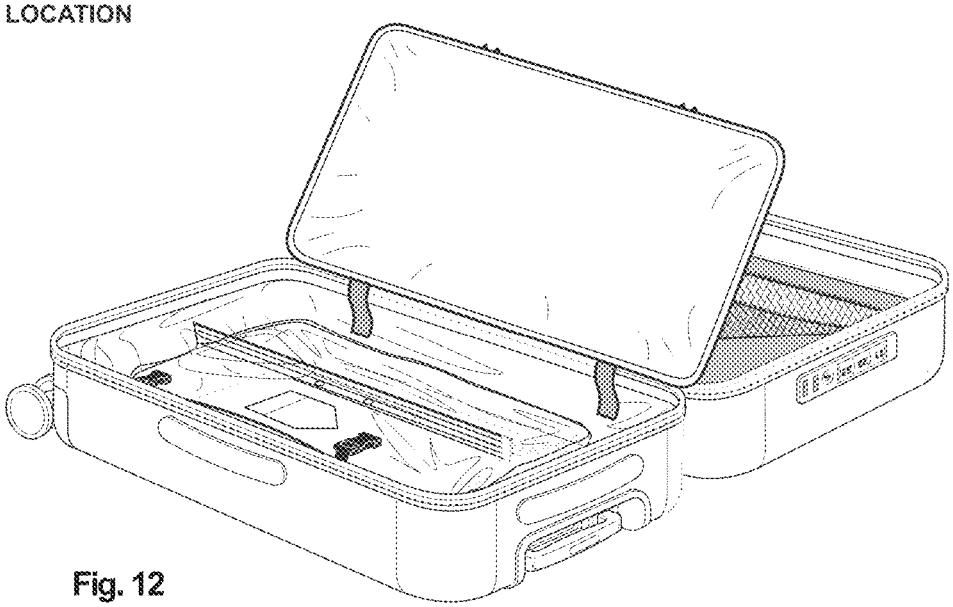

FIGS. 10-12 show the Detachable Compression Cap mounted in or to the trolley assembly. In this non-limiting embodiment, the valve of the Vacuum Compression Bag "VCB" can be located at the bottom of the VCB and preferably aligned with the Detachable Compression Cap that is fastened or otherwise attached to the plate of the Trolley assembly. Since the VCB can be preferably removable for purposes of VCB replacement (though such is not considered limiting and non-removable VCBs are also considered within the scope of the disclosure), the user can connect or disconnect the VCB valve from the detachable compression cap affixed to the plate of the Trolley assembly. One preferred non-limiting manner of locking the VCB valve with the Detachable Compression Cap could be a half turn locking feature that provides an air tight connection.

Figure 13:
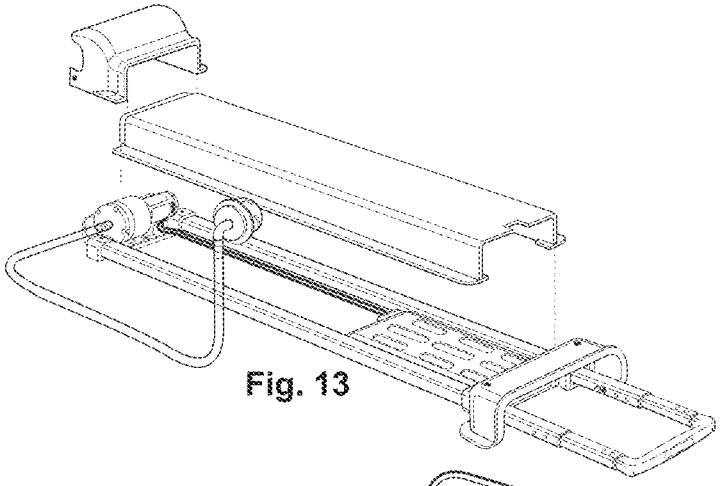
FIGS. 13, 14 and 15 illustrate the Detachable Compression Cap connecting with the VCB Valve located on the lower portion of a vacuum compression bag in accordance with the present disclosure.
Figure 14:
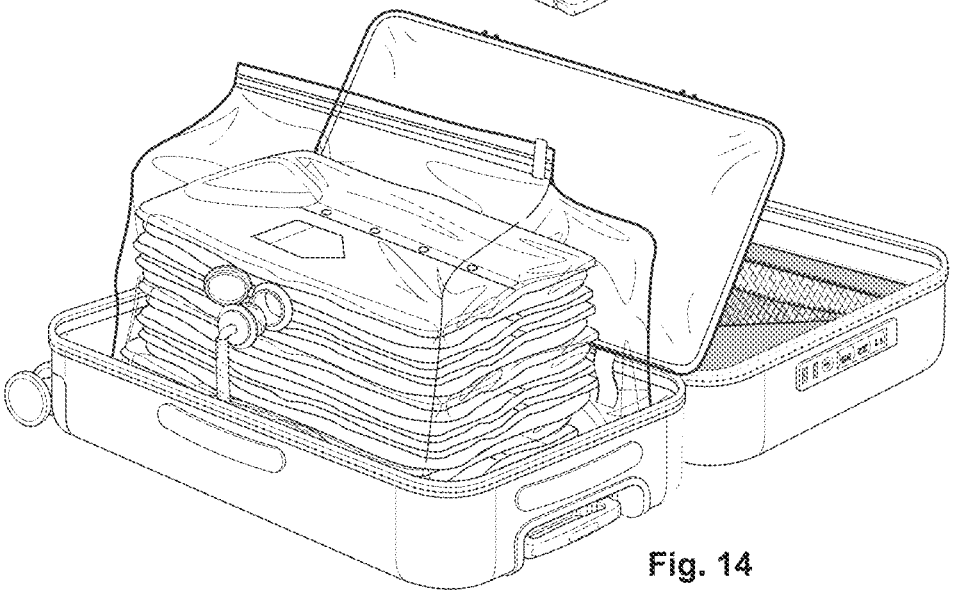
Figure 15:
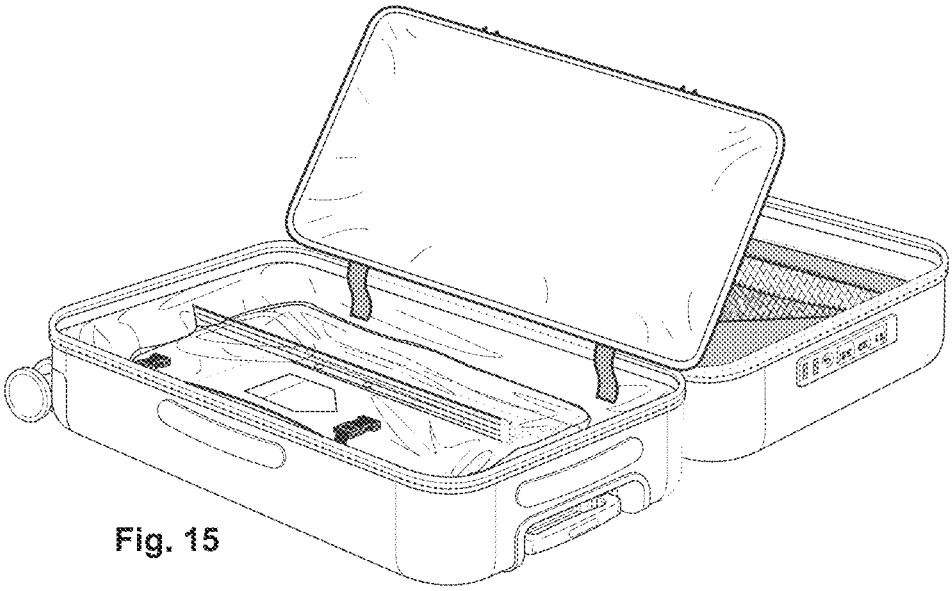

FIGS. 13-15 show the Detachable Compression Cap connecting with the VCB Valve which can be located on the lower portion of vacuum compression bag. The Detachable Compression Cap can be at the end of a flexible tube connected with the intake port of the internal vacuum pump. In this non-limiting embodiment, the tube can come from the bottom of the suitcase where the vacuum pump is located and can be of sufficient length to reach the VCB valve. The Compression cap may either remain connected after vacuum compression or can be disconnected for use with other VCBs or for storage during travel.

Figure 16:
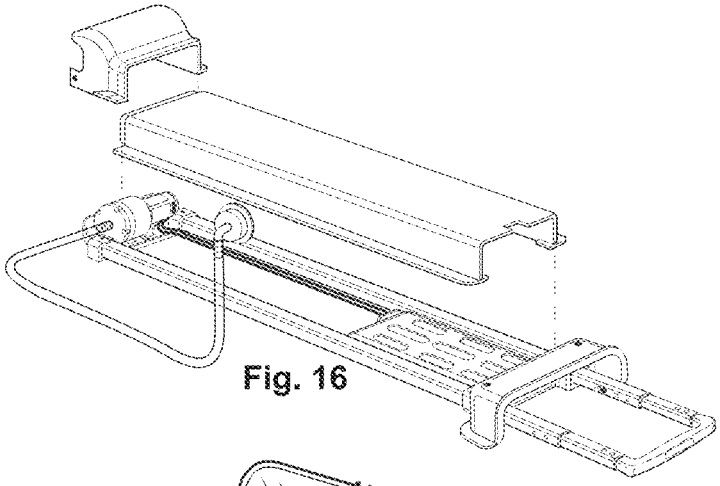
FIGS. 16, 17 and 18 illustrate the Detachable Compression Cap connecting with the VCB Valve located on the upper portion of the vacuum compression bag in accordance with the present disclosure.
Figure 17:
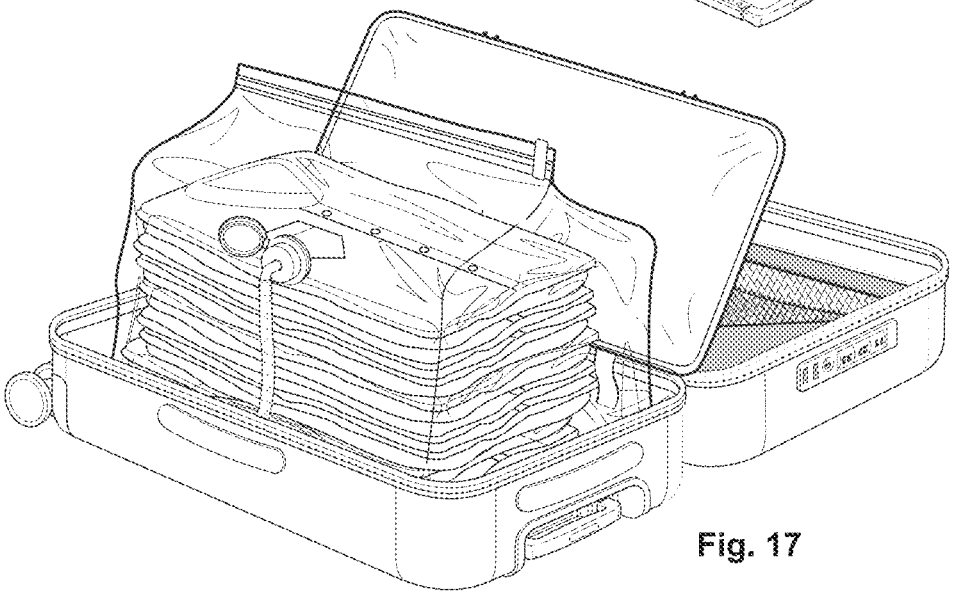
Figure 18:
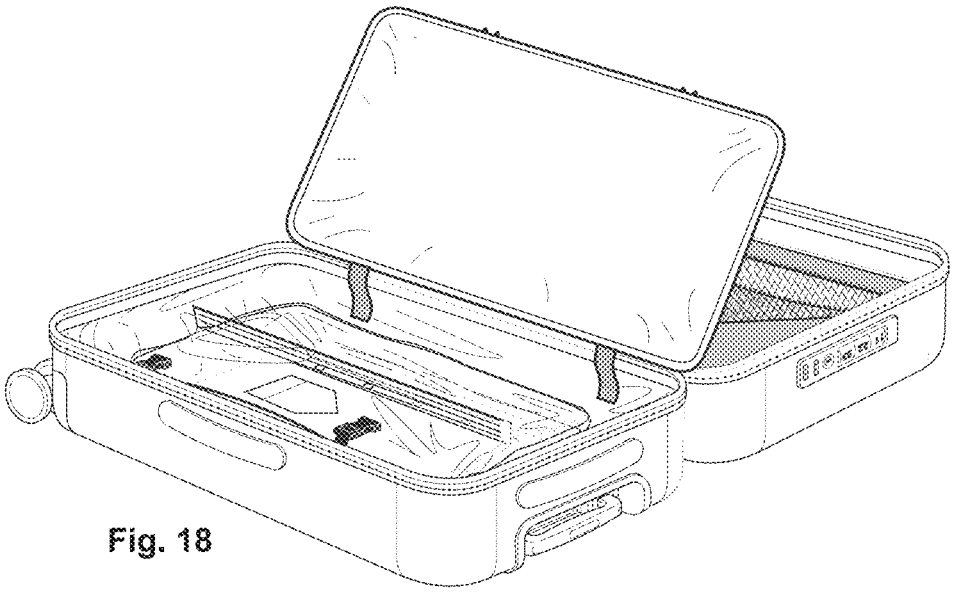

FIGS. 16-18 show the Detachable Compression Cap connecting with the VCB Valve which can be located on the upper portion of vacuum compression bag. The Detachable Compression Cap can be at the end of a flexible tube connected with the intake port of the internal vacuum pump. In this non-limiting embodiment, the tube can come from the bottom of the suitcase where the vacuum pump is located and can be of sufficient length to reach the VCB valve. The Compression cap may either remain connected after vacuum compression or be disconnected for use with other VCBs or for storage during travel.

It should be understood that the exemplary embodiments described herein should be considered in a descriptive sense only and not for purposes of limitation. Descriptions of features or aspects within each embodiment should typically be considered as available for other similar features or aspects in other embodiments. While one or more embodiments have been described with reference to the Figures, it will be understood by those of ordinary skill in the art that various changes in form and details may be made therein without departing from their spirit and scope.

All components of the described system and their locations, electronic, gas/air and mechanical communication/connection methods between the system components, pumps, power sources, shell materials, bag materials, valves, dimensions, materials, cases, values, etc. discussed above or shown in the drawings, if any, are merely by way of example and are not considered limiting and other component(s) and their locations, electronic, gas/air and mechanical communication/connection methods between the system components, pumps, power sources, shell materials, bag materials, valves, dimensions, materials, cases, values, etc. can be chosen and used and all are considered within the scope of the disclosure.

Dimensions of certain parts as shown in the drawings may have been modified and/or exaggerated for the purpose of clarity of illustration and are not considered limiting.

While the novel components have been described and disclosed in certain terms and has disclosed certain embodiments or modifications, persons skilled in the art who have acquainted themselves with the disclosure, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. A latch assembly adapted for positioning a removable battery within a travel bag, the travel bag having trolley bridge member secured to a handle portion of the travel bag, the bridge member having a plurality of walls and a bottom surface and defining a battery insertion and passthrough area, the bottom surface having an opening for insertion and removal of a removable battery therethrough, the latch assembly comprising:

a latch movable in a linear position parallel with the opening in the bottom surface and adapted for contacting a top surface of a battery when the battery is inserted into the travel bag; the latch including a body having a length that is sufficient in size to fully cover the opening in the bottom surface when the latch is in a fully closed position;

and a spring exerting force to maintain the latch in the fully closed position covering the opening and bottom surface and adapted to be compressed upon force exerted by a user to move the latch linearly inward to either an first position where an inserted battery is accessible while still fully maintained by the latch within the travel bag or to a second position where the battery is released and extends at least partially through the opening in the bottom surface to allow a user to remove the battery out of the travel bag.

2. The latch assembly of claim 1 wherein the spring having a first end in contact with the latch and a second end in contact with an internal wall surface; wherein the spring in an extended position positions a catch portion of the latch in contact with a top area of the battery when the battery is internally disposed within the travel bag through the bottom surface opening within an area of the travel bag between the bridge member and the cradle.

3. A latch assembly adapted for positioning a removable battery within a travel bag, the travel bag having trolley member secured to a handle portion of the travel bag, the bridge member having a plurality of walls and a bottom surface and defining a battery insertion and passthrough area, the bottom surface having an opening for insertion and removal of a removable battery therethrough, the latch assembly comprising:

a latch movable in a linear position parallel with the opening in the bottom surface and adapted for contacting a top surface of a battery when the battery is inserted into the travel bag; the latch including a body having a length that is sufficient in size to fully cover the opening in the bottom surface when the latch is in a fully closed position and a spring exerting force to maintain the latch in the fully closed position covering the opening and bottom surface and adapted to be compressed upon force exerted by a user to move the latch linearly inward to either an first position where an inserted battery is accessible while still fully maintained by the latch within the travel bag or to a second position where the battery is released and extends at least partially through the opening in the bottom surface to allow a user to remove the battery out of the travel bag;

further comprising a cradle disposed within the travel bag and located under the opening in the bottom surface and at least one spring contacting the cradle at one end and which is compressed when the battery is fully inserted between the cradle and the bridge member.

4. The latch assembly of claim 3 wherein the battery when inserted into the bottom surface opening is received within an area of the travel bag between the bridge member and the cradle such that the battery compresses the at least one spring and is maintained in position compressing the at least one spring by the latch contacting the top surface of the battery.

5. The latch assembly of claim 3 wherein the cradle having an opening; wherein when the battery is received within an area of the travel bag between the bridge member and the cradle one or more electrical contacts or electrical connectors disposed on a bottom surface of the battery are accessible through the cradle opening for mating with corresponding contacts or electrical connectors of an electrical device contained within the travel bag.

6. The latch assembly of claim 5 wherein the electrical device contained within the travel bag is a vacuum pump.

7. The latch assembly of claim 3 wherein the spring having a first end in contact with the latch and a second end in contact with an internal wall surface;

wherein the spring in an extended position positions a catch portion of the latch in contact with a top area of the battery when the battery is internally disposed within the travel bag through the bottom surface opening within an area of the travel bag between the bridge member and the cradle.

8. A latch assembly adapted for positioning a removable battery within a travel bag, the travel bag having trolley bridge member secured to or associated with a handle portion of the travel bag, the bridge member having by a plurality of walls and a bottom surface and defining a battery insertion and passthrough area, the bottom surface having an opening for insertion and removal of a removable battery therethrough, the latch assembly comprising:

a latch adapted for contacting a top surface of a battery when the battery is inserted into the travel bag; the latch including a body having a length that is sufficient in size to fully cover the opening in the bottom surface when the latch is in a fully closed position; and a spring exerting force to maintain the latch in the fully closed position covering the opening and bottom surface and adapted to be compressed upon force exerted by a user to move the latch linearly inward to either an first position where an inserted battery is accessible while still fully maintained by the latch within the travel bag or to a second position where the battery is released and extends at least partially through the opening in the bottom surface to allow a user to remove the battery out of the travel bag;

the spring having a first end in contact with the latch and a second end in contact with an internal wall surface;

wherein the spring in an extended position positions a catch portion of the latch in contact with a top area of the battery when the battery is internal disposed within the travel bag through the bottom surface opening;

wherein the latch including a bridge member cover having a tab member depending downward from an outward end of the cover;

wherein in a latch closed position the bridge member cover is disposed over the opening in the bottom surface of the bridge member and the inserted battery and the tab member is disposed on an opposite side of the opening from the latch;

wherein in a partially opened position the bridge member cover is moved inward such that the tab member is adjacent to the latch with the spring extended so that latch still maintains the battery within the travel bag and with any electrical ports or outlets or interface disposed on a top surface of the battery accessible to a user;

wherein in a fully opened position a user pushes the bridge member cover further inward causing the tab member to contact the latch member which compresses the spring and moves the latch member inward such that the latch member no longer maintains the battery in position and the battery is permitted to be removed from the travel bag by the user.

9. A latch assembly adapted for positioning a removable battery within a travel bag, the travel bag having trolley bridge member secured to or associated with a handle portion of the travel bag, the bridge member having by a plurality of walls and a bottom surface and defining a battery insertion and passthrough area, the bottom surface having an opening for insertion and removal of a removable battery therethrough, the latch assembly comprising:

a latch movable in a linear position parallel with the opening in the bottom surface and adapted for contacting a top surface of a battery when the battery is inserted into the travel bag; the latch including a body having a length that is sufficient in size to fully cover the opening in the bottom surface when the latch is in a fully closed position;

a spring exerting force to maintain the latch in the fully closed position covering the opening and bottom surface and adapted to be compressed upon force exerted by a user to move the latch linearly inward to either an first position where an inserted battery is accessible while still fully maintained by the latch within the travel bag or to a second position where the battery is released and extends at least partially through the opening in the bottom surface to allow a user to remove the battery out of the travel bag;

a cradle disposed within the travel bag and located under the opening in the bottom surface, the cradle having an opening; and at least one spring contacting the cradle at one end and which is compressed when the battery is fully inserted between the cradle and the bridge member;

wherein the battery when inserted into the bottom surface opening is received within the cradle such that the battery compresses the at least one spring and is maintained in position compressing the at least one spring by the latch contacting the top surface of the battery;

wherein when the battery is received within an area of the travel bag between the bridge member and the cradle one or more electrical contacts or electrical connectors disposed on a bottom surface of the battery are accessible through the cradle opening for mating with corresponding contacts or electrical connectors of an electrical device contained within the travel bag.

10. The latch assembly of claim 9 wherein the electrical device contained within the travel bag is a vacuum pump.

11. The latch assembly of claim 9 wherein the spring having a first end in contact with the latch and a second end in contact with an internal wall surface;

wherein the spring in an extended position positions a catch portion of the latch in contact with a top area of the battery when the battery is internal disposed within the travel bag through the bottom surface opening.

12. A latch assembly adapted for positioning a removable battery within a travel bag, the travel bag having trolley bridge member secured to or associated with a handle portion of the travel bag, the bridge member having by a plurality of walls and a bottom surface and defining a battery insertion and passthrough area, the bottom surface having an opening for insertion and removal of a removable battery therethrough, the latch assembly comprising:

a latch adapted for contacting a top surface of a battery when the battery is inserted into the travel bag; the latch including a body having a length that is sufficient in size to fully cover the opening in the bottom surface when the latch is in a fully closed position;

a spring exerting force to maintain the latch in the fully closed position covering the opening and bottom surface and adapted to be compressed upon force exerted by a user to move the latch linearly inward to either an first position where an inserted battery is accessible while still fully maintained by the latch within the travel bag or to a second position where the battery is released and extends at least partially through the opening in the bottom surface to allow a user to remove the battery out of the travel bag;

a cradle disposed within the travel bag and located under the opening in the bottom surface, the cradle having an opening; and at least one spring contacting the cradle at one end and which is compressed when the battery is fully inserted between the cradle and the bridge member;

wherein the battery when inserted into the bottom surface opening is received within an area of the travel bag between the bridge member and the cradle such that a bottom surface of the battery compresses the at least one spring and is maintained in position compressing the at least one spring by the latch contacting the top surface of the battery;

wherein when the battery is received within the area of the travel bag between the bridge member and the cradle one or more electrical contacts or electrical connectors disposed on a bottom surface of the battery are accessible through the cradle opening for mating with corresponding contacts or electrical connectors of an electrical device contained within the travel bag;

the spring having a first end in contact with the latch and a second end in contact with an internal wall surface;

wherein the spring in an extended position positions a catch portion of the latch in contact with a top area of the battery when the battery is internal disposed within the travel bag through the bottom surface opening;

a bridge area cover having a tab member depending downward from an outward end of the cover;

wherein in a closed position the bridge member cover is disposed over the bottom surface opening and the inserted battery and the tab member is disposed on an opposite side of the opening from the latch;

wherein in a partially opened position the bridge member cover is moved inward such that the tab member is adjacent to the latch with the spring extended so that latch still maintains the battery within the travel bag and with any electrical ports or outlets or interface disposed on the surface of the battery accessible to a user;

wherein in a fully opened position a user pushes the bridge member cover further inward causing the tab member to contact the latch member which compresses the spring and moves the latch member inward such that the latch member no longer maintains the battery in position and the battery is permitted to be removed from the travel bag by the user.

13. A battery latching, release and ejection assembly adapted for use with travel bags, the travel bag having an electrical component having contact pins, comprising:

a spring loaded cradle disposed within an interior area of a travel bag below a battery insertion opening in the travel bag;

a fastening latch disposed within the interior area and position near a top area of a battery when a bottom area of the battery is received within the spring loaded cradle, in a first position the latch covering the battery insertion opening and the latch maintaining at least a bottom area of the battery within the cradle against tension from a spring member of the spring loaded cradle, the latch movable in a linear non-rotatable parallel position with respect to the battery insertion opening;

wherein when a battery is inserted into the spring loaded cradle, the spring becomes loaded and the battery is held in place by the fastening latch and electrical contact pins located on a bottom surface of the battery makes electrical connection with contact pins of an electrical component also externally disposed within the travel bag the fastening latch including a body having a length that is sufficient in size to fully cover an opening in the top area in a closed position and movable to a first open position where an inserted battery is accessible while still fully maintained by the fastening latch within the travel bag or to a second open position where the battery is released and extends at least partially through the opening at the top area to allow a user to remove the battery out of the travel bag.

* * * * *